US009466181B2

(12) United States Patent
Berman et al.

(10) Patent No.: US 9,466,181 B2
(45) Date of Patent: Oct. 11, 2016

(54) GAMING METHOD AND APPARATUS WITH DYNAMIC ELEMENT FUNCTION

(76) Inventors: Bradley Berman, Minnetonka, MN (US); Adam Martin, St. Louis Park, MN (US); Chad Shapiro, Plymouth, MN (US); Ryan Strand, Hopkins, MN (US); Nate Norbie, Chaska, MN (US)

( * ) Notice: Subject to any disclaimer, the term of this patent is extended or adjusted under 35 U.S.C. 154(b) by 1347 days.

(21) Appl. No.: 12/504,617

(22) Filed: Jul. 16, 2009

(65) Prior Publication Data

US 2010/0016054 A1 Jan. 21, 2010

Related U.S. Application Data

(60) Provisional application No. 61/135,015, filed on Jul. 16, 2008.

(51) Int. Cl.
*A63F 9/24* (2006.01)
*G07F 17/34* (2006.01)

(52) U.S. Cl.
CPC ..... *G07F 17/34* (2013.01)

(58) Field of Classification Search
CPC ..... G07F 17/34
USPC ..... 463/16–21, 25, 31
See application file for complete search history.

(56) References Cited

U.S. PATENT DOCUMENTS

| | | | | |
|---|---|---|---|---|
| 6,234,897 | B1 | 5/2001 | Frohm | |
| 7,056,209 | B2 | 6/2006 | Baerlocher | |
| 7,074,127 | B2 | 7/2006 | Cuddy | |
| 7,077,745 | B2 | 7/2006 | Gomez | |
| 7,094,148 | B2 | 8/2006 | Baerlocher | |
| 7,121,943 | B2 | 10/2006 | Webb | |
| 7,144,322 | B2 | 12/2006 | Gomez | |
| 2002/0025846 | A1* | 2/2002 | Bennett et al. | 463/20 |
| 2003/0040357 | A1 | 2/2003 | Baerlocher | |
| 2003/0057645 | A1* | 3/2003 | Baerlocher et al. | 273/138.2 |
| 2003/0060267 | A1* | 3/2003 | Glavich et al. | 463/20 |
| 2003/0073483 | A1 | 4/2003 | Glavich | |
| 2003/0203753 | A1 | 10/2003 | Muir | |
| 2004/0038726 | A1 | 2/2004 | Inoue | |
| 2004/0038730 | A1 | 2/2004 | Suda | |
| 2004/0048646 | A1 | 3/2004 | Visocnik | |
| 2004/0097280 | A1 | 5/2004 | Gauselmann | |
| 2004/0219969 | A1* | 11/2004 | Casey et al. | 463/20 |
| 2005/0026679 | A1 | 2/2005 | Lucchesi | |
| 2005/0043085 | A1 | 2/2005 | Baerlocher | |
| 2005/0164774 | A1 | 7/2005 | Gauselmann | |
| 2005/0233801 | A1 | 10/2005 | Baerlocher | |
| 2006/0068884 | A1 | 3/2006 | Baerlocher | |
| 2006/0073876 | A1 | 4/2006 | Cuddy | |
| 2006/0089192 | A1 | 4/2006 | Okada | |
| 2006/0116196 | A1 | 6/2006 | Vancura | |
| 2006/0172795 | A1 | 8/2006 | Bussick | |
| 2006/0205469 | A1 | 9/2006 | Schultz | |
| 2006/0211489 | A1 | 9/2006 | Walker | |
| 2006/0281525 | A1 | 12/2006 | Borissov | |
| 2007/0004489 | A1 | 1/2007 | Rodgers | |
| 2008/0113735 | A1* | 5/2008 | Maya | 463/20 |

* cited by examiner

*Primary Examiner* — Ronald Laneau
*Assistant Examiner* — Ross Williams

(57) ABSTRACT

A method and apparatus for use in gaming activities such as slot machine. A plurality of symbols is presented in connection with a gaming activity. At least one multi-characteristic symbol capable of exhibiting a plurality of different gaming characteristics is also presented. A first gaming characteristic is attributed to the multi-characteristic symbol during play of the gaming activity. The multi-characteristic symbol's first gaming characteristic is replaced with a second gaming characteristic if none of the remaining plurality of symbols exhibit the second gaming characteristic.

20 Claims, 15 Drawing Sheets

| Combination Operation | Sub-criteria sample | Result |
|---|---|---|
| Sum | +1, +2, 0, +1 | All wilds become 4x wilds. |
| Sum | +1, 0, -1, +2 | All wilds become 2x wilds. |
| Product | 1, 2, 1, 1 | All wilds become 2x wilds. |
| Product | 1, 2, ½, 4, ½ | All wilds become 2x wilds. |
| All to Highest | 2x, 3x, 1x, 1x | All wilds become 3x wilds. |
| All to Lowest | 2x, 3x, 6x, 3x | All wilds become 2x wilds. |
| Selectable | 2x, 3x, 6x, 3x | All wilds become Yx wilds, where Y is the player-selected multiplier. |

1000

GAMING METHOD AND APPARATUS WITH DYNAMIC ELEMENT FUNCTION

RELATED APPLICATIONS

This application claims the benefit of Provisional Application No. 61/135,015, filed on Jul. 16, 2008, to which priority is claimed pursuant to 35 U.S.C. §119(e), and which is hereby incorporated herein by reference in its entirety.

FIELD OF THE INVENTION

This invention relates in general to gaming systems and processes, and more particularly to a gaming method and apparatus with dynamic element function.

BACKGROUND OF THE INVENTION

Gaming devices such as slot machines have entertained the public for over a century. While the fundamental concept behind slot games has remained relatively intact, the manners of computing, displaying, and participating in modern day slot games have changed dramatically. One force driving these changes is technological advancement, such as the advent of computers and video capabilities. Another driving force is human nature, as the participants of such gaming devices demand continual excitement and stimulation. It is therefore important in the gaming industry that gaming innovations continue to be rolled out to the participating public.

Many gaming methods and apparatuses require that combinations of marked elements be displayed in order for a payout to be triggered. For example, three adjacent elements marked with cherry symbols my trigger a payout in traditional slot games. Some games include the use of "wild" element markings which can allow the element to correspond to any other element for the purpose of forming combinations of marked elements that trigger payouts. Therefore, players like to see the generation of "wild" markings, as well as other markings associated with bonuses and high payouts. Players may feel luckier, and more inclined to continue playing, when playing on a machine that generates many bonus and high payout element markings. Players may favor playing at machines that generate lots of bonus and high payout element markings because they feel that such a machine provides the best chance to win.

Elements associated with bonuses and high payouts are typically not generated in each round of typical game play, a consequence of randomly selecting the markings for gaming elements. A lack of randomly generated bonus and high-payout elements can sap the excitement and moral of players, making them more likely to lose interest in the game and stop playing.

SUMMARY OF THE INVENTION

To overcome limitations in the prior art described above, and to overcome other limitations that will become apparent upon reading and understanding the present specification, the present disclosure discloses an apparatus and method with dynamic element function.

Various embodiments of the invention include marking elements of a play area and adding at least one function to all elements marked with a first type of marking if no elements of the play area are marked with a second type of marking. In various embodiments, each different element marking type can be associated with a particular function.

Winning combinations of corresponding markings that trigger one or more payouts can be identified, the function of each marking enabling the elements of the combination to correspond to one another.

In these and various other embodiments, the first type of marking to which the at least one function is added can be randomly selected from the plurality of markings to receive the at least first function.

Such embodiments can include identifying corresponding combinations of the elements based on their respective markings both prior to and after adding the at least one function to all elements marked with the first type of marking.

In these and various other embodiments, adding the at least one function to all elements marked with the first type of marking can comprise replacing the at least one function of the elements marked with the first type of marking with a second function associated with the second type of marking.

In these and various other embodiments, the second function can be a wild function and the second type of marking indicates that each element marked with the second type of marking can function as wild.

In these and various other embodiments, the second function can be a multiplier function and the second type of marking indicates that each element marked with the second type of marking can function as a multiplier to increase a payout.

In these and various other embodiments, adding the at least one function may further comprise marking all elements marked with the first type of marking with the second type of marking so that each of the elements marked with the first type of marking exhibit the first type of marking and the second type of marking.

In these and various other embodiments, adding the at least one function may further comprise replacing a previous function of the elements marked with the first type of marking with the at least one function, the previous function associated with the first type of marking.

In these and various other embodiments, each added at least one function may be randomly selected from a plurality of different functions respectively associated with different marking types not previously randomly selected for marking of elements in the play area.

In these and various other embodiments, the added at least one function can be selected by a user from a plurality of different functions.

In these and various other embodiments, the added at least one function may enable elements to which the at least one function is added to correspond to other elements also associated with the at least one function and trigger a payout.

In these and various other embodiments, all elements marked with the first type of marking may be enabled with both a first function associated with the first type of marking and the added at least one function after adding the at least one function to all elements marked with the first type of marking.

Various embodiments of the present disclosure concern a gaming apparatus for facilitating a game and include a display device, and circuitry configured to: facilitate presentation of a plurality of elements forming a grid on the display device, control marking the plurality of elements, evaluate the plurality of markings, add at least one function to all elements marked with a first type of marking if no elements of the play area are marked with a second type of marking based on the evaluation, and identify one or more combinations of marked elements, the elements of each combination corresponding to one another due at least in part to the at least one function added to one or more elements of each combination. Such embodiments can employ any of the features of the method embodiments discussed above.

Various embodiments of the present disclosure include a computer-readable medium having computer-executable instructions stored thereon and executable by a processing system for presenting a plurality of symbols in connection with a gaming activity, including at least one multi-characteristic symbol capable of exhibiting a plurality of different gaming characteristics. A first gaming characteristic can be attributed to the multi-characteristic symbol during play of the gaming activity. The multi-characteristic symbol's first gaming characteristic can be replaced with a second gaming characteristic if none of the remaining plurality of symbols exhibit the second gaming characteristic. Such embodiments can employ any of the features of the method embodiments discussed above.

Also, various embodiments of the present disclosure include means for presenting a plurality of symbols in connection with a gaming activity, including at least one multi-characteristic symbol capable of exhibiting a plurality of different gaming characteristics, means for attributing a first gaming characteristic to the multi-characteristic symbol during play of the gaming activity, and means for attributing a second gaming characteristic to the multi-characteristic symbol if none of the remaining plurality of symbols exhibit the second gaming characteristic. Such embodiments can employ any of the features of the method embodiments discussed above.

Various embodiments concern aggregate element functionality. For example, various embodiments concern a method of facilitating game play having aggregate element functionality, comprising: marking elements of a play area, including marking a plurality of the elements as wild, determining a multiplier value based on a respective attribute of each element of the plurality marked as wild, attributing the multiplier value to each of the elements of the plurality marked as wild, identifying one or more winning combinations of marked elements that include at least one of the elements marked as wild, and determining a payout for each of the one or more winning combinations that include at least one of the elements marked as wild based on an award amount associated with the identified winning combination in a pay table multiplied by the multiplier value.

In various aggregate functionality method embodiments, marking elements of the play area can comprise assigning a value to each of the elements marked as wild, and determining the multiplier value based on the respective attributes from the plurality of elements marked as wild can comprise adding the values from each of the plurality of wild elements.

In various aggregate functionality method embodiments marking elements of the play area can comprise assigning a value to each of the elements marked as wild, and determining the multiplier value based on the respective attributes from the plurality of elements marked as wild can comprise multiplying the values from each of the plurality of wild elements.

In various aggregate functionality method embodiments marking elements of the play area can comprise respectively assigning values to the elements of the plurality marked as wild, and the multiplier value may be determined to be the greatest value of the values from the plurality of elements marked as wild.

Various aggregate functionality method embodiments can include that marking elements of the play area comprises respectively assigning values to the elements of the plurality marked as wild, and the multiplier value can be determined to be the lowest value of the values from the plurality of elements marked as wild.

In various aggregate functionality method embodiments identifying the respective one or more winning combinations of marked elements can comprise identifying a combination of correspondingly marked elements arranged in an adjacent series, the elements being correspondingly marked based on being marked with a common marking-type and at least one of elements being marked as wild.

In various aggregate functionality method embodiments determining the payout for each of the at least one identified winning combination of elements can comprise for each of the winning combinations composed of multiple wild elements, adding the multiplier value of each of the elements of the winning combination marked as wild to yield a total multiplier value and multiplying the total multiplier value by the award amount from the paytable to determine the payout.

In various aggregate functionality method embodiments determining the payout for each of the at least one identified winning combination of elements can comprise for each of the winning combinations composed of multiple wild elements, multiplying the multiplier value of each of the elements of the winning combination marked as wild to yield a total multiplier value and multiplying the total multiplier value by the award amount from the paytable to determine the payout.

Various embodiments concern a method of facilitating game play having aggregate element functionality, comprising: marking elements of a play area, including marking a plurality of the elements with attributes, determining an aggregate value based on the attributes of the plurality of elements, and attributing the aggregate value to each of the plurality of elements.

In various aggregate functionality method embodiments, the plurality of elements marked with attributes can be randomly selected for marking with the attributes.

In various aggregate functionality method embodiments the plurality of elements marked with attributes can be marked with the attributes based on the plurality of elements being marked with a common marking type.

In various aggregate functionality method embodiments the plurality of elements marked with attributes can be marked with the attributes based on the plurality of elements being marked as wild.

In various aggregate functionality method embodiments the aggregate value can be a multiplier value that is applied to any winning combination of the marked elements that include at least one of the plurality of elements.

In various aggregate functionality method embodiments the aggregate values of multiple of the plurality of elements can be added and then applied to a payout associated with a winning combination of marked elements that include the multiple of the plurality of elements.

In various aggregate functionality method embodiments determining the aggregate value can comprise adding the attributes of the plurality of elements to yield the aggregate value.

In various aggregate functionality method embodiments determining the aggregate value can comprise multiplying the attributes of the plurality of elements to yield the aggregate value.

Various embodiments concern a computer-readable medium having instructions stored thereon which are executable by the processor for facilitating a game performing steps comprising: marking elements of a play area, including marking a plurality of the elements as wild, determining a multiplier value based on a respective attribute of each element of the plurality marked as wild, attributing the multiplier value to each of the elements of the plurality marked as wild, identifying one or more winning combinations of marked elements that include at least one of the elements marked as wild, and determining a payout for each of the one or more winning combinations that include at least one of the elements marked as wild based on an award amount associated with the identified winning combination in a pay table multiplied by the multiplier value.

In various computer-readable medium based aggregate functionality embodiments the computer-readable medium can have further instructions stored thereon which are executable by the processor for facilitating the game such that: marking elements of the play area comprises assigning a value to each of the elements marked as wild, and determining the multiplier value based on the respective attributes from the plurality of elements marked as wild comprises adding the values from each of the plurality of wild elements.

In various computer-readable medium based aggregate functionality embodiments the computer-readable medium can have further instructions stored thereon which are executable by the processor for facilitating the game such that marking elements of the play area comprises assigning a value to each of the elements marked as wild, and determining the multiplier value based on the respective attributes from the plurality of elements marked as wild comprises multiplying the values from each of the plurality of wild elements.

In various computer-readable medium based aggregate functionality embodiments the computer-readable medium can have further instructions stored thereon which are executable by the processor for facilitating the game such that: marking elements of the play area comprises respectively assigning values to the elements of the plurality marked as wild, and the multiplier value is determined to be the greatest value of the values from the plurality of elements marked as wild.

In various computer-readable medium based aggregate functionality embodiments the computer-readable medium can have further instructions stored thereon which are executable by the processor for facilitating the game such that: marking elements of the play area comprises respectively assigning values to the elements of the plurality marked as wild, and the multiplier value is determined to be the lowest value of the values from the plurality of elements marked as wild.

In various computer-readable medium based aggregate functionality embodiments the computer-readable medium can have further instructions stored thereon which are executable by the processor for facilitating the game such that: identifying the respective one or more winning combinations of marked elements comprises identifying a combination of correspondingly marked elements arranged in an adjacent series, the elements being correspondingly marked based on being marked with a common marking-type and at least one of elements being marked as wild.

In various computer-readable medium based aggregate functionality embodiments the computer-readable medium can have further instructions stored thereon which are executable by the processor for facilitating the game such that: for each of the winning combinations composed of multiple wild elements, adding the multiplier value of each of the elements of the winning combination marked as wild to yield a total multiplier value and multiplying the total multiplier value by the award amount from the paytable to determine the payout.

In various computer-readable medium based aggregate functionality embodiments the computer-readable medium can have further instructions stored thereon which are executable by the processor for facilitating the game such that: for each of the winning combinations composed of multiple wild elements, multiplying the multiplier value of each of the elements of the winning combination marked as wild to yield a total multiplier value and multiplying the total multiplier value by the award amount from the paytable to determine the payout.

Various embodiments concern a gaming apparatus for facilitating a game comprising a display device and circuitry configured to: facilitate presentation of a play area having multiple elements on the display device, control marking the multiple elements of the play area, including marking a plurality of the elements with attribute values, calculate an aggregate total based on the attributes values, indicate the aggregate total in association with each of the elements of the plurality on the display device, identify one or more winning combinations of the marked elements that include at least one of the elements of the plurality associated with the aggregate total, and determine a payout for each of the one or more winning combinations based on an award amount associated with the identified winning combination in a pay table augmented by the aggregate total.

In various aggregate functionality gaming apparatus embodiments the circuitry can be configured such that the plurality of elements marked with attribute values are randomly selected for marking with the attribute values.

In various aggregate functionality gaming apparatus embodiments the plurality of elements marked with the attribute values can be marked with the attribute values based on the plurality of elements being marked with a common marking type.

In various aggregate functionality gaming apparatus embodiments the plurality of elements marked with attribute values can be marked with the attribute values based on the plurality of elements being marked as wild.

In various aggregate functionality gaming apparatus embodiments the aggregate total can be a multiplier value that is applied to any winning combination of the marked elements that include at least one of the plurality of elements.

In various aggregate functionality gaming apparatus embodiments the aggregate totals of multiple of the plurality of elements can be added and then multiplied by the payout associated with a winning combination of marked elements that include the multiple of the plurality of elements.

In various aggregate functionality gaming apparatus embodiments the aggregate total comprises adding the attribute values of the plurality of elements to yield the aggregate total.

In various aggregate functionality gaming apparatus embodiments the aggregate total can comprise multiplying the attribute values of the plurality of elements to yield the aggregate total.

In various aggregate functionality gaming apparatus embodiments determining the aggregate total can comprise using the highest of the attributes values as the aggregate total.

Various embodiments concern a gaming apparatuses having aggregate element functionality, comprising: means for marking elements of a play area, including marking a plurality of the elements as wild, means for determining a multiplier value based on a respective attribute of each element of the plurality marked as wild, means for attributing the multiplier value to each of the elements of the plurality marked as wild, means for identifying one or more winning combinations of marked elements that include at least one of the elements marked as wild, and means for determining a payout for each of the one or more winning combinations that include at least one of the elements marked as wild based on an award amount associated with the identified winning combination in a pay table multiplied by the multiplier value.

These and various other advantages and features of novelty which characterize the invention are pointed out with particularity in the claims annexed hereto and form a part hereof. However, for a better understanding of the invention, its advantages, and the objects obtained by its use, reference should be made to the drawings which form a further part hereof, and to accompanying descriptive matter, in which there are illustrated and described specific examples of an apparatus in accordance with the invention.

BRIEF DESCRIPTION OF THE DRAWINGS

The invention is described in connection with the embodiments illustrated in the following diagrams.

DETAILED DESCRIPTION OF THE ILLUSTRATED EMBODIMENTS

Figure 1A:
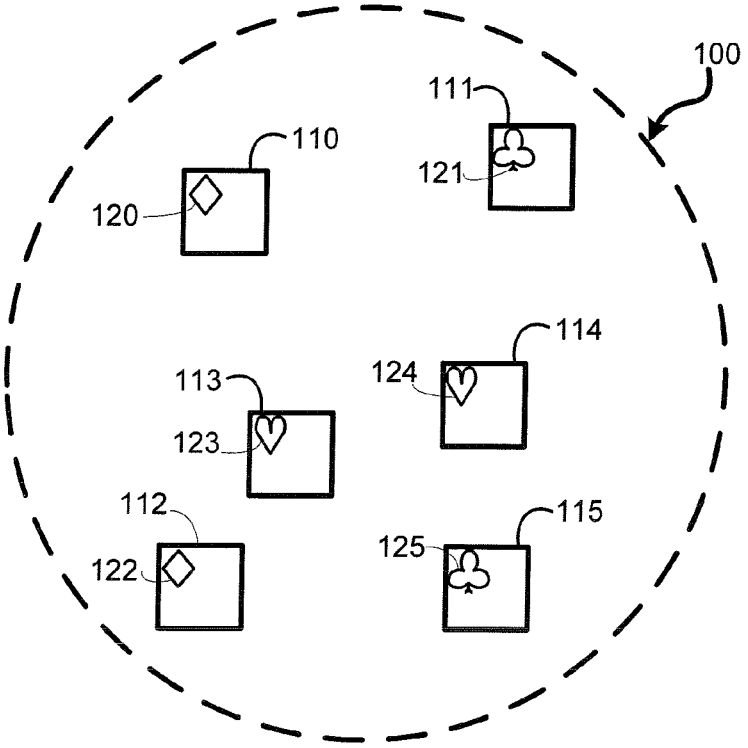
FIGS. 1A-B illustrate an embodiment of a gaming activity using dynamic element function.

In the following description of the invention, reference is made to the accompanying drawings which form a part hereof, and in which is shown by way of illustration the specific embodiment in which the invention may be practiced. It is to be understood that other embodiments may be utilized, as structural and operational changes may be made without departing from the scope of the present invention.

The discussion and illustrations provided herein are presented in an exemplary format, wherein selected embodiments are described and illustrated to present the various aspects of the present invention. Systems, devices, or methods according to the present invention may include one or more of the features, structures, methods, or combinations thereof described herein. For example, a device or system may be implemented to include one or more of the advantageous features and/or processes described below. A device or system according to the present invention may be implemented to include multiple features and/or aspects illustrated and/or discussed in separate examples and/or illustrations. It is intended that such a device or system need not include all of the features described herein, but may be implemented to include selected features that provide for useful structures, systems, and/or functionality.

The present invention, as described more fully below, is applicable to various gaming activities that are played on a gaming board or gaming machine, including slot games such as reel slots and video slots, and other games utilizing a string of symbols to generate a game result. The present invention is generally described in terms of slot machines to provide an understanding of the invention. While the invention is particularly advantageous in the context of slot machines, and while a description in terms of slot machines facilitates an understanding of the invention, the invention is also applicable to other gaming activities of chance utilizing symbol strings as will be readily apparent to those of skill in the art from the description provided herein.

As is described more fully below, the present disclosure provides dynamic element function. However, the invention is equally applicable in connection with secondary modes, such as bonus modes of play. As is known in the art, bonus events are used in gaming activities such as slot games, which provides an alternative mode of play that is intended to attract and captivate players of such slot games. Generally, a bonus game or event on a slot machine is typically an additional gaming reel or machine, or a random selection device, that is enabled by a bonus qualifying signal from an underlying or primary gaming activity. Generally, a predetermined prize-winning combination of symbols in an underlying or primary slot game may result in the player being awarded one or more bonus games. Often the bonus event has a much higher probability of triggering a payout, thereby instilling a great interest by players in being awarded bonus events. One aspect of the present disclosure ensures that symbols associated with bonuses and/or high payouts can be presented in game, despite the symbols being randomly generated.

Figure 1B:
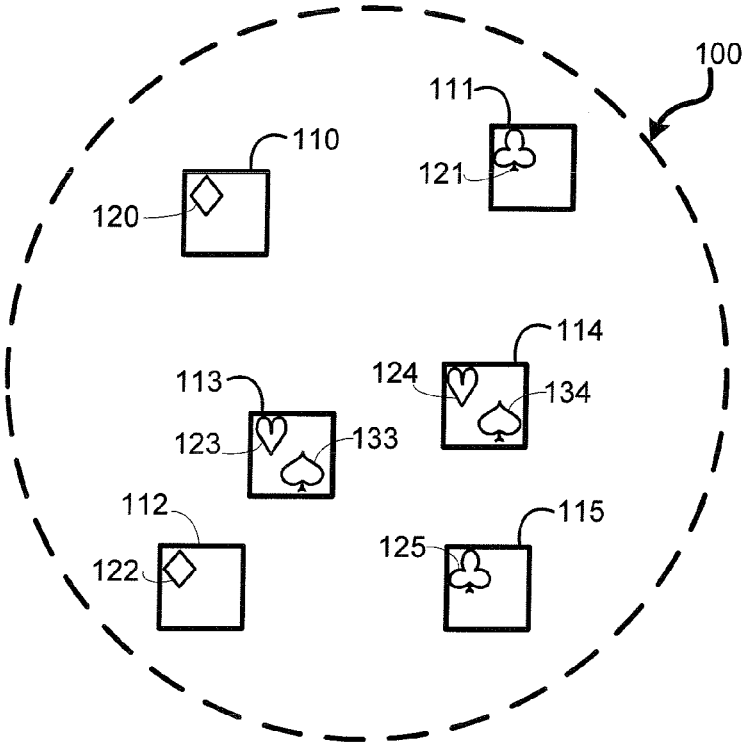

FIGS. 1A-B illustrates an embodiment of the invention with dynamic element function. A play area 100 is populated by a plurality of elements, such as elements 110-115. All of the elements of the play area 100 are illustrated as squares, but in various other embodiments of the present disclosure, the elements could be other shapes, including but not limited to circles, ovals, triangles, pentagons, hexagons, octagons, and the like. Three dimensional play areas and elements are also contemplated within the scope of the invention.

Elements 110-115 have each been marked with symbols 120-125, respectively. The symbol markings 120-125 of the particular elements 110-115 could be randomly selected for each element 110-115, or could be selected according to a pre-made plan. In various embodiments of the present disclosure, a particular type of marking of a plurality of different possible markings can be repeatedly used to mark populating elements. In other embodiments, a particular type of marking of the plurality of different possible markings can only be used to mark populating elements a certain number of times. For example, a particular play area may only have four spade symbols with which to mark elements of the play area.

The elements 110-115 of the play area 100 are marked with four types of symbol markings. Elements 110 and 112 are respectively marked with diamond symbols 120 and 122. Elements 113 and 114 are respectively marked with heart symbols 123 and 124. Elements 111 and 115 are respectively marked with club symbols 121 and 125. No elements of the play area 100 of FIG. 1A are marked with a spade symbol, which in the particular embodiment of FIGS. 1A-B has relevance that will be discussed later.

Each of the symbol markings 120-125 attributes a particular function to each of the respective elements 110-115. There are many possible functions associated with markings according to the present disclosure. Functions can enable, disable, or trigger aspects of game play. Aspects of game play can be awards, payouts, bonuses, game advancement, game termination, modification of game play, and correspondence, among others.

Elements 110 and 112, respectively marked with diamonds 120 and 122, can be enabled with a function associated with diamond symbols. In some embodiments of the present disclosure, a function associated with a particular marking will enable an element or symbol to correspond with other elements or symbols, wherein a predetermined combination of corresponding elements or symbols will trigger a payout or bonus. For example, three different elements could each be marked with one of three cherry symbols, the three cherry symbols enabling the three elements to correspond with one another to trigger a payout. If each of the three elements were alternatively marked with a cherry symbol, a bell symbol, and a bar symbol, the elements would not be enabled to correspond to one another to trigger a payout.

FIG. 1B illustrates the same play area 100 and gaming embodiment of FIG. 1A at a later stage of game play. In this later state of game play, elements 113 and 114 are respectively marked with spade symbols 133 and 134. According to the particular gaming embodiment of FIGS. 1A-B, elements 113 and 114 were respectively marked with spade symbols 133 and 134 because no element of the play area 100 was marked with a spade symbol in the earlier stage of game play illustrated in FIG. 1A. In this way, a function associated with each of the spade symbols was added to each of the elements 113 and 114 marked with heart symbol 123 and 124, as no elements were marked with spade symbols in the earlier stage of game play.

Although the elements marked with heart symbols were marked with spade symbols in the later stage of game play, other elements could have been marked with the spade symbols. For example, elements 110 and 112, respectively marked with diamond symbols 120 and 122, could each have been marked with spade symbols in the later stage of game play. Also, elements could be marked with symbols other than spade symbols during the later stage of game play.

Marking, as used herein, includes distinguishing at least one element from at least one other element. There are many ways in which one element can be distinguished from another element, and therefore there are many different ways to mark an element. Marking can include placing and/or representing a symbol, one or more colors, flag, character, image, graphic, number, letter, shape, feature, or design on, or in association with, an element.

Marking is not limited to elements. Various types of play area components of the present disclosure can also be marked. For example, boundaries, grid spaces, voids, sides, corners and the like can also be marked. Moreover, a particular part of an element can be marked, such as a side or a corner of an element.

One element can be distinguished from another element by locating the elements at different heights, rotating one or both of the elements, flipping one or both of the elements, moving one or both of the elements, resizing one of both of the elements, deforming one or both of the elements, modifying one or both of the elements and/or combining one or both of the elements with at least one other element. Distinguishing of elements can be done to physical elements, such as element pieces of a board or on a reel strip. Distinguishing of elements can also be represented on a display screen.

Figure 2A:
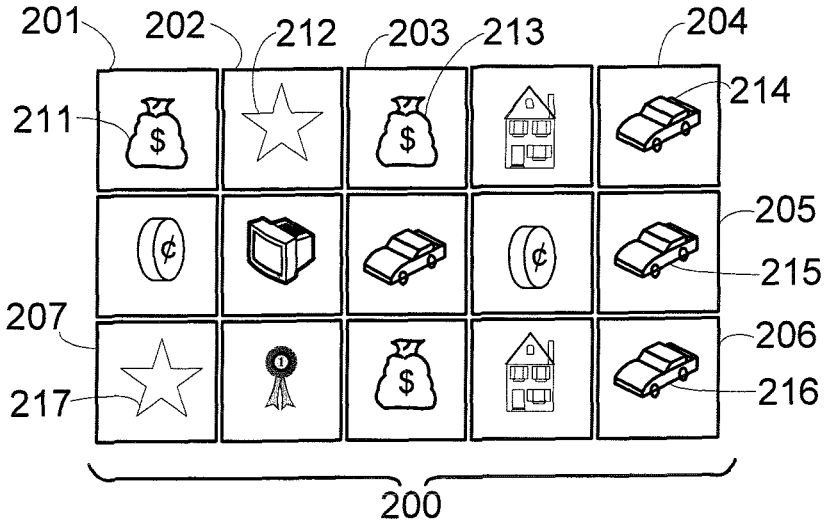
FIGS. 2A-B illustrate another embodiment of a gaming activity using dynamic element function.
Figure 2B:
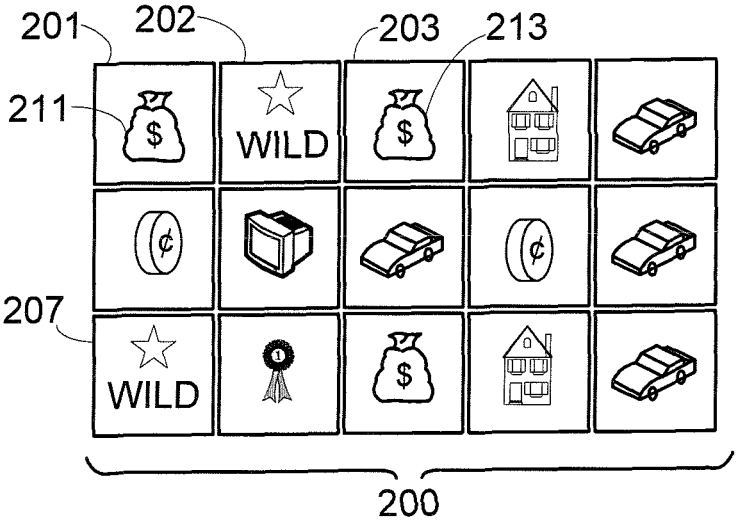

FIGS. 2A-B illustrate an embodiment of the present disclosure at various stages of game play demonstrated in an element grid. FIG. 2A includes a play area comprising a grid 200. The grid 200 includes a plurality of grid elements, such as elements 201-207. Each of the elements of the grid 200 has been marked with one of a plurality of different symbols in an initial stage of game play. For example, elements 201-207 were respectively marked with money bag symbol 211, star symbol 212, money bag symbol 213, car symbol 214, car symbol 215, car symbol 216, and star symbol 217.

Each of the symbol markings of the grid 200 is associated with at least one of a plurality of different functions. For example, elements 204-206 are each enabled with a function associated with a car symbol because each of elements 204-206 are marked with car symbols 214-216, respectively. In the particular embodiment of FIGS. 2A-B, each car symbol is associated with the function of enabling an element marked with a car symbol to correspond to other elements marked with car symbols.

According to the particular embodiment of FIGS. 2A-B, payouts are issued only for combinations of adjacently located corresponding elements. Elements 204-206 meet this criteria as illustrated in FIG. 2A.

There are many different ways in which elements of the various embodiments of the present disclosure can be adjacent to one another. For example, elements 204 and 205 have proximate and opposing walls. One element can be adjacent to multiple other elements. For example, element 205 is adjacent to element 206 because they have proximate and opposing walls. Furthermore, element 205 is adjacent to element 206 because they have proximate and opposing walls.

According to various embodiments of the present disclosure, elements in contact and/or within close proximity to one another can be considered to be adjacent. Elements can be in contact with one another by sharing walls, lines, points, corners, segments, portions and/or features. Elements can also be in contact by overlapping each other. Other types of adjacency may be provided as well. For example, in one embodiment, only those symbols that are adjacent in a horizontal or vertical fashion will be deemed "adjacent" for purposes of providing a payout. Alternatively, only symbols that are horizontal, or that are vertical, or that are diagonal, may be deemed adjacent. Symbols may also be deemed adjacent along opposite edges of the play area, as if the edges were wrapped around to intersect with one another. Three dimensional display grids may also be used in accordance with the present disclosure, such that elements sharing a wall, corner or segment may be considered to be adjacent.

Returning to the embodiment illustrated in FIG. 2A, elements marked with money bag symbols may be enabled to correspond to other elements marked with money bag symbols. As such, elements 201 and 213 could correspond to one another to trigger a payout. However, in the particular embodiment of FIGS. 2A-2B, the payout criteria requires a combination of at least three corresponding adjacent elements. Therefore, despite elements 201 and 203 being enabled to correspond to each other because each is respectively marked with money bag symbols 211 and 213, elements 201 and 203 are too few in number and are not adjacent to one another. While a game player may ordinarily be disappointed with the course of game play illustrated in FIG. 2A because a payout was tantalizingly close to being triggered, aspects of the present disclosure includes a second stage of game play that can allow the game player a second chance to win. In this way, the anticipation and excitement of the player can be stoked over a longer period of time, increasing the enjoyment of game play for the player.

FIG. 2B illustrates a latter stage of game play relative to FIG. 2A. In this later stage, elements 202 and 207 exhibit dynamic function abilities. While in the earlier stage of game play illustrated in FIG. 2A, elements 202 and 207 were only enabled with the function of corresponding to other elements marked with star symbols, the functionality of elements 202 and 207 has been changed to include corresponding to any other elements.

Dynamic function, as used herein, includes adding, substituting, discontinuing, or otherwise modifying one or more functions of a game element or marking to change the functionality of the game element or marking.

The functionality of elements 202 and 207 was changed because no elements of the grid 200 were enabled with the functionality of corresponding to any other elements (i.e. no WILD markings) in the earlier stage of game play illustrated in FIG. 2A. According to the particular embodiment of FIGS. 2A-B, only elements marked as WILD elements are enabled with the functionality to correspond to any other element. Because no elements of the grid 200 were enabled with the functionality associated with a WILD marking, the functionality of elements 202 and 207 is changed to include the functionality associated with a WILD marking.

As one having ordinary skill in the art will understand upon reading this disclosure, WILD functionality increases the chances of forming winning combinations. The use of wild elements can be used to control the odds of a player winning and/or enhance the thrill of game play.

In the particular embodiment illustrated in FIGS. 2A-B, changing the functionality of elements 202 and 207 to correspond to any other elements enables elements 201-203 to form a combination of adjacent corresponding elements. As such, the dynamic element functionality aspect of the present disclosure allowed what would have otherwise been a near payout into an actual payout.

Even if the functionality of element 202 had not been changed and the functionally of other elements marked with something other than a star symbol had had their functionality changed (i.e. the change in functionality did not result in a win), aspects of the present disclosure still enhance game play. For example, a player, familiar with the aspects of game play of the embodiment illustrated in FIGS. 2A-B, may view the earlier stage of game play illustrated in FIG. 2A and recognize that elements 201 and 203 would form a corresponding series of adjacent elements if the functionality of element 202 was changed to correspond to elements 201 and 203 (e.g., exhibit WILD characteristics), and further recognize that because no elements exhibit such functionality in the earlier round of game play, that element 202 could be changed to exhibit such functionality in a subsequent round of game play. In this way, the anticipation and thrill of game play is enhanced at least between the stages of game play as a series of elements that is close to triggering a payout may imminently be turned into a series of corresponding adjacent elements that can trigger a payout.

While some games may sweeten rewards, such as by merely adding a multiplier effect to awards already triggered, dynamic functionality can turn what would otherwise be a failure in a first stage of game play into a win in a latter stage of game play. Moreover, some of the beneficial aspects of dynamic element function are accomplished not based on what is present (such as with multiplier bonuses or WILD elements), but rather based on what is not present. As such, a potential player can be assured that particular types of elements and functions that players generally like to see, such as wild, bonus, and high payout elements, will be present at some time during the course of game play, even if in a more drawn-out fashion. In this way, even if all grid elements are randomly populated, it can still be assured that certain elements will always be represented.

While elements 204-206 of FIG. 2A correspond to one another because each has been marked with a car symbol marking, there are various other ways in which elements can correspond to one another, according to various embodiments of the present disclosure. For example, elements could correspond to one another not by having the same mark, but rather by just having a mark at all. But in some embodiments of the present disclosure, elements will only correspond if they have the same letter, number, symbol, image, color, or other similar marking. In some embodiments of the present disclosure, elements will correspond if they are marked with markings selected from a particular group, and the elements need not all have identical markings to correspond to one another. For example, elements of a corresponding series of marked elements may correspond because each is marked with an image of a dog, even though all image markings on the elements are of a different breed of dog.

In some embodiments of the present disclosure, elements correspond to one another if their markings form a progressive series. In such embodiments, adjacent elements might only correspond if they are marked with consecutive numbering, such as if elements 201-203, were each marked 1, 2, and 3, respectively. In other embodiments, letter marked elements of a segment may only correspond if the adjacent elements spell a word. However, the present disclosure is not so limited in all embodiments. Other types of element correspondence are contemplated. For example, marked elements may correspond because, according to a pay table, the combination of the elements triggers a payout.

Figure 3A:
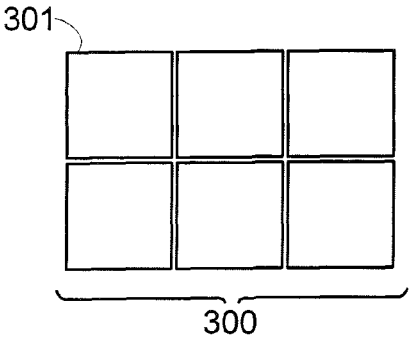
FIGS. 3A-D illustrate another embodiment of a gaming activity using dynamic element function.
Figure 3B:
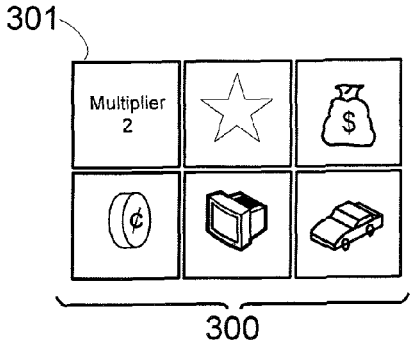

FIG. 3A illustrates an unmarked display grid 300. FIG. 3B illustrates the display grid 300 of FIG. 3A after elements of the display grid 300 have been marked. Element 301 has been marked so as to have the characteristic of a multiplier. According to the embodiment of FIGS. 3A-D, the presence of a multiplier can enhance payouts. Specifically, if a winning combination was formed by the marked elements of the display grid, then element 301 can exhibit the characteristic of multiplying the payout by 2 (double the payout). However, no winning combinations of marked elements are present in FIG. 3B.

According to the embodiment of FIGS. 3A-D, the characteristics of marked elements can change during the course of game play. In this embodiment, the multiplier characteristic of elements marked to exhibit multiplier characteristics can be replaced if the other marked elements are not marked to exhibit a second type of characteristic. The second characteristic in this particular embodiment is a combination of marked elements that trigger a payout. No marked elements of FIG. 3B exhibit a payout triggering characteristic, as none of the element markings of the display grid 300 correspond to one another. Therefore, according to the rules of the particular embodiment of FIGS. 3A-D, the characteristic of the elements marked to exhibit the second type of characteristic can be replaced.

Figure 3C:
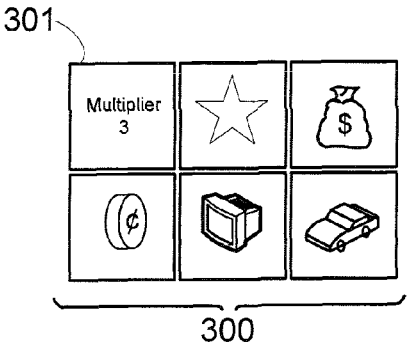

FIG. 3C illustrates the replacement of a characteristic of a marked element. The multiplier characteristic of marked element 301 was replaced because no elements of the display grid 300 were marked to exhibit the characteristic of a winning combination. The characteristic of marked element 301 was replaced with a triple multiplier, such that if a winning combination is formed, the payout associated with the winning combination is multiplied by 3.

Figure 3D:
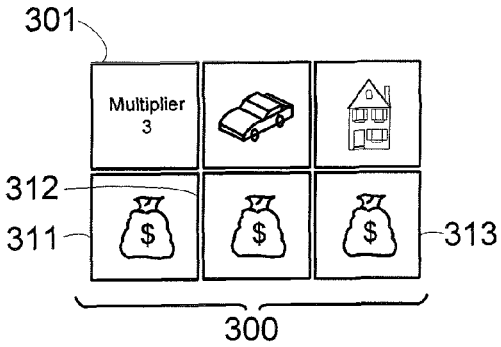

FIG. 3D illustrates a further round of game play, where all elements of the display area 300 have been remarked with a randomly selected marking, except for element 301 marked to exhibit the multiplier characteristic. In this further round of game play, the elements of the display area 300 do exhibit a winning combination characteristic. Each of elements 311-313 are respectively marked with a money bag symbol to exhibit the characteristic of corresponding to other similarly marked elements to form a winning combination. As such, a payout will be triggered by marked elements 311-313, and that payout will be affected by the multiplier characteristic of element 301.

Although the multi-characteristic aspects of the embodiment of FIGS. 3A-D did not enable a payout that would not have otherwise occurred, the multi-characteristic aspects did increase a payout of a later round of game play. In this way, the multi-characteristic aspects can enhance game play by providing a benefit for the player despite the player not winning a payout in the first round of game play, thereby encouraging the player to play further.

In some embodiments of the present disclosure, if elements 311-313 had not been marked to exhibit a payout triggering characteristic, and no other elements of the display area 300 had been marked to exhibit a payout triggering characteristic, then the multiplier characteristic of element 301 would be replaced with a quadruple multiplier.

Although the embodiment of FIGS. 3A-3D replaced a multiplier characteristic of an element with an incremented multiplier characteristic, various other embodiments of the present disclosure are not so limited. For example, one or more elements exhibiting a characteristic other than a multiplier could be replaced. In various embodiments, characteristics being replaced could be replaced with a characteristic that is not a multiplier.

Figure 4A:
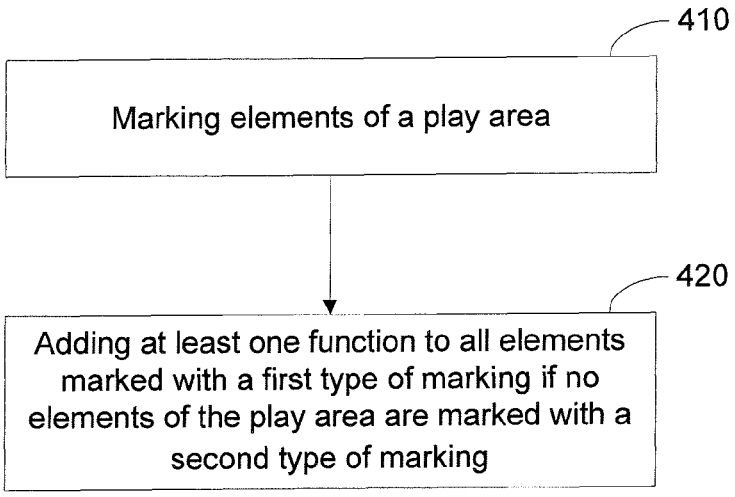
FIGS. 4A-B exhibit flow diagrams of exemplary embodiments of methods for using dynamic element function.

FIG. 4A illustrates a method utilizing dynamic element function in accordance with various embodiments of the present disclosure. The method of FIG. 4A can correspond to the embodiments illustrated and/or described elsewhere herein, such as those of FIGS. 1A-2B. The method of FIG. 4A includes marking 410 elements of a play area. Marking 410 can be done in any manner discussed herein, including marking the elements with randomly selected markings. It should be noted that "randomly" in this sense does not require pure randomness; e.g., the selected markings may be, and often are, weighted in some fashion. Thus, "random" or "randomly" as used herein refers to at least some degree of randomness.

The method further includes adding 420 at least one function to all elements marked with a first type of marking if no elements of the play area are marked with a second type of marking.

Although at least one function is added 410 according to the method embodiment of FIG. 4A, other modes of function modification for possible. For example, a function could be replaced. Therefore, in embodiments where a function is added, the element(s) to which the function was added could retain the original associated function and further exhibit the added function. However, in embodiments where an original function of an element is replaced by another function, the element may no longer retain the original function after replacement. Other function modification schemes are contemplated within the scope of the present disclosure.

Figure 4B:
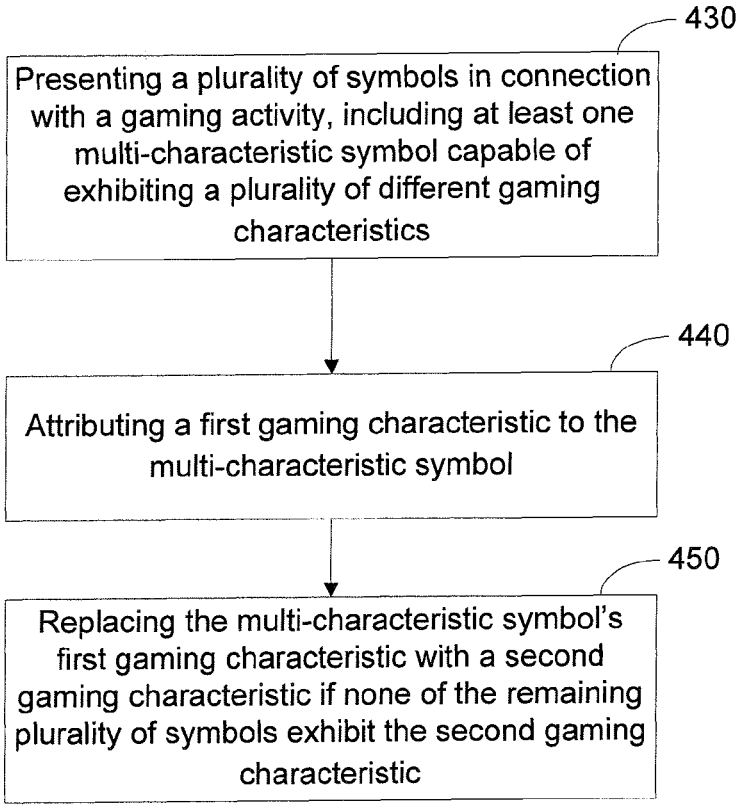

FIG. 4B illustrates a method utilizing dynamic element function in accordance with various embodiments of the present disclosure. The method of FIG. 4B includes presenting 430 a plurality of symbols in connection with a gaming activity, including at least one multi-characteristic symbol capable of exhibiting a plurality of different gaming characteristics. The plurality of symbols can be presented in a gaming display in connection with a gaming activity. The plurality of symbols can be randomly selected.

The method of FIG. 4B further includes attributing 440 a first gaming characteristic to the multi-characteristic symbol during play of the gaming activity. Attributing can include marking or in some other way associating the first gaming characteristic with the multi-characteristic symbol. For example, the multi-characteristic symbol may be attributed with the characteristic of corresponding to similarly marked symbols to form winning combinations.

The attribution 440 of a first gaming characteristic can be triggered by the presentation 430 of a particular symbol type of the plurality of symbols. For example, a numeric "7" symbol may be presented 430 in a display grid, and then the characteristic of allowing the "7" symbol to correspond to other "7" symbols may be attributed 440 to the "7" symbol, correspondence of a sufficient number of "7" symbols triggering a payout. Alternatively, or additionally, a doubling multiplier effect may be attributed 440 to all "7" symbols presented 430.

The method of FIG. 4B further includes replacing 450 the multi-characteristic symbol's first gaming characteristic with a second gaming characteristic if none of the remaining plurality of symbols exhibit the second gaming characteristic. The remaining symbols may be those symbols of the gaming display that are not the multi-characteristic symbols.

Continuing with the example discussed above, the correspondence characteristic of the "7" symbol may be replaced with a "wild" characteristic if no other presented 430 symbols are attributed 440 with a "wild" characteristic. Furthermore, in the alternative/additional example, a second gaming characteristic may be a triple multiplier, such that if no triple multiplier characteristics are attributed 440 to any of the presented 430 symbols, the doubling multiplier characteristic is replaced by the triple multiplier characteristic.

Figure 5:
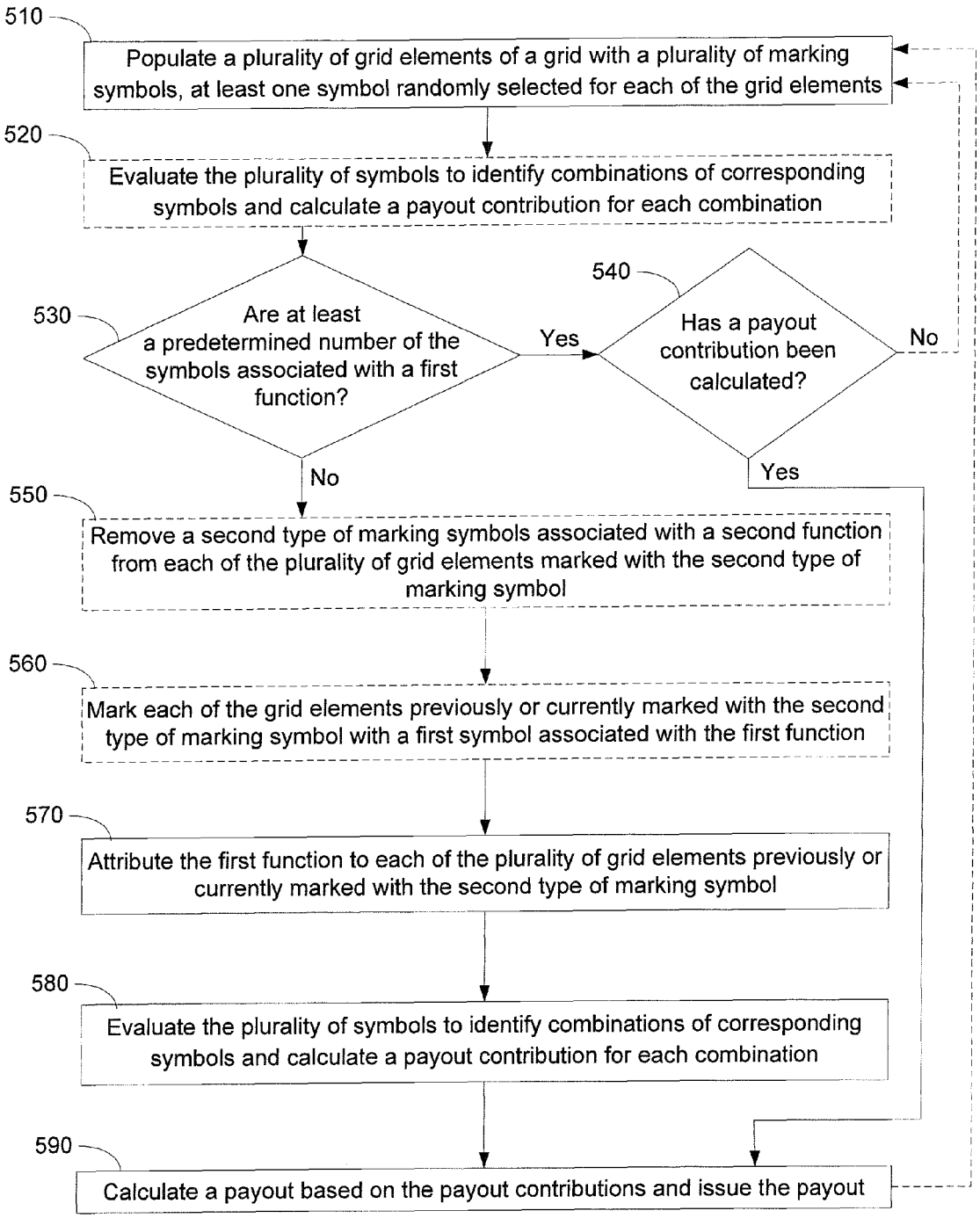
FIG. 5 is another flow diagram of an exemplary embodiment of a method for using dynamic element function.

FIG. 5 is a flow diagram demonstrating a method of dynamic element function in accordance with various embodiments of the present disclosure. Several of the step blocks and connecting lines of FIG. 5 are dashed, indicating that the particular step may optionally be practiced, although one having ordinary skill in the art could make other modifications to the flow diagram while still utilizing dynamic element function game play.

The method of FIG. 5 includes populating 510 a plurality of grid elements of a grid with a plurality of marking symbols, at least one symbol randomly selected for each of the grid elements. Each symbol can be associated with a particular function, the function for each symbol depending on the particular symbol type randomly selected for the grid location.

The method of FIG. 5 can also include evaluating 520 the plurality of symbols to identify combinations of corresponding symbols and calculating a payout contribution for each combination. Each payout contribution may be calculated according to a pay table.

At decision block 530, the method evaluates whether at least a predetermined number of the symbols are associated with a first function. The predetermined number could be any number in various embodiments, including 1, 2, 3, etc. The predetermined number could be the same as the number of symbols that are needed to correspond to one another in a group to trigger a payout. The first function could be any function discussed herein, including the function of adjacent element corresponding to other another, the correspondence based on matching symbol markings.

If at least a predetermined number of the symbols are associated with the first function, then the method advances to decision block 540, which evaluates whether a payout contribution has been calculated. A payout contribution can be calculated in step 520, among others. If a payout has been calculated, then a total payout is calculated 590 based on the payout contributions and the total payout is issued to the player. If decision block 540 determines that no payout contributions have been calculated, then the game play round can end and the method returns to populating 510 the grid elements with new randomly selected marking symbols.

If at least the predetermined number of the symbols are not associated with the first function, then the method may next advance to step 550, 560, or 570, depending on which steps are enabled in the particular method embodiment. At step 550, a second type of marking symbol associated with a second function is removed 550 from each of the plurality of grid elements marked with the second type of marking. In some embodiments of the present disclosure, as each second type of marking symbol is removed 550 from each grid element, the associated second function is also removed.

The method of FIG. 5 may include marking 560 each of the grid elements previously or currently marked with the second type of marking symbol with a first symbol associated with the first function. In some embodiments of the present disclosure, "previously marked" refers to grid elements marked during the current round, however the present disclosure is not necessarily so limited in all embodiments, and the status of having been previously marked by a particular type of marking symbol can carry through multiple rounds.

Regardless of whether one or both of steps 550 and 560 are performed, the method can include attributing 570 the first function to each of the plurality of grid elements previously or currently marked with the second type of marking symbol. If the second type of marking symbol was not removed 550, then a grid element can be marked with the second type of marking symbol while exhibiting the first function and the second function associated with the second type of marking symbol.

After attributing 570 the first function, the method includes evaluating 580 the plurality of symbols to identify combinations of corresponding symbols and calculating a payout contribution for each combination. Combinations of corresponding symbols identified in the evaluation 580 may be enabled because of the attribution 570 of the first function to grid elements marked with the second type of marking. For example, the first function attributed 570 may be a wild symbol, such that the attribution of the wild function to a grid element enables completion of a corresponding combination that triggers a payout contribution.

After evaluation 580 of the symbols and calculation of all payout contributions, a total payout is calculated 590 based on the payout contributions and the total payout is issued. In some embodiments of the present disclosure, the issuing of the total payout may be delayed by the user, by operation of the game or by another game. For example, a bonus game may be played after the game embodied in the flow chart of FIG. 5 is completed, where the total payout is put at stake in another game.

Various embodiments of the present disclosure as described herein using dynamic element function contrast with other gaming embodiments where a play area is populated by marked elements and one or more of the marking types are guaranteed (e.g., by programming) to be used to mark an element, such that not all elements are randomly marked (e.g., an element is deliberately marked as wild instead of being randomly marked as wild). In various embodiments of the present disclosure, elements are marked in a first round in a random fashion (e.g., using a random number generator), and then if a type of marking is absent after the markings are randomly made, then the missing marking type or a different marking type can supplement or replace one of the randomly generated markings. Game play in this manner provides several unique aspects and advantages. For example, randomly marking elements and then evaluating the markings to determine whether a particular type of marking is present allows a first chance for that type of marking to be presented in a more natural manner. Therefore, the initial marking of the elements is done in a random manner, instead of reserving certain elements or marking types for specific marking outside of the random marking process. Randomly marking all elements can provide a more genuine "game of chance" experience to a gamer, while subsequent evaluation and marking supplementation to ensure the presence of certain types of markings provides gamers with expanded winning opportunities and drawn-out game play excitement.

The present disclosure contemplates several different ways for the dynamic elements (i.e. those being modified in function based on the absence of another type of element or function) to be selected. For example, if it is determined that no elements of a marked play area are marked to exhibit a first type of function, a second type of function can be added to a randomly selected type of element marking.

For example, in the embodiment of FIGS. 2A-B, it is the elements 202 and 207 exhibiting star symbols 212 and 217 that are supplemented with wild functionality in the second round. In some embodiments, the type of marking to supplement could be randomly selected (e.g., by use of a random number generator). This concept adds a further aspect of uncertainly to game play, as it will remain unclear to the player until the random selection just how many elements will be supplemented. For example, if a TV symbol type was alternatively selected to be supplemented based on the absence of wild markings in the first round, then only one element would be supplemented with wild functionality in the second round. But if the house marking type is randomly selected, then double the amount of wild markings will be added in the second round of game play as compared to random selection of TV marking type. In this way, a player will eagerly await the random selection of the type of marking to be modified, because this further random selection can result in a relatively large or small increase in ability to form matches and generate payouts, depending on the quantity of the type of marking randomly selected for modification.

In some embodiments using dynamic element function, the type of element or symbol to be modified or supplemented is predetermined. For example, it may be predetermined that the lowest value symbols (e.g., associated with lower a payout relative to others marking types according to a pay table) may be modified with a second function in a second round of game play if a first function marking was not randomly added in a first round. Furthermore, if lowest value symbols were also not randomly selected for presentation in the first round, then the next-lowest value symbols may be modified with a second function in a second found if a first function marking was not randomly added in a first round of game play. This escalation can continue until the second function is added. In some embodiments, some players may prefer the replacement of the lower values markings, as opposed to randomly selecting the type of marking to be replaced, as the player may not want marking types associated with higher value payouts to be randomly selected for replacement.

In some embodiments using dynamic element function, a play area is marked and if at least a predetermined number of elements are marked with a common marking-type (e.g., star symbol) but these elements are not used in forming a winning combination of elements, then these symbols can be changed into wilds and the play area reevaluated to determine if this change created any new winning combinations. In such embodiments, functionality of some elements is changed based on what was not previously present in the play area.

In some embodiments using dynamic element function, one or more elements will be made wild (or enabled with some other functionality) and then made to move about the play area while the elements and markings of the play area are reevaluated to see if the relocation of the one or more elements forms a new winning combination. This relocating can continue until one of the one or more moving elements reaches the perimeter of the play area, all of the one or more moving elements reaches the perimeter of the play area, the moving one or more elements have visited all play area locations and a reevaluation performed, the moving one or more elements have visited a predetermined number of locations and reevaluations performed for each location, the play area has been reevaluated while the moving one or more elements has been located in a space that does not form a winning combination, and/or the play area has been reevaluated while the moving one or more elements has been located in a space that does form a winning combination.

Dynamic element function as discussed herein may be used if an insufficient number of markings are present. Most embodiments discussed herein have this number as one (e.g., invoking dynamic function if a first type of marking is not present). However, the number could be two, or greater, in some embodiments. For example, in some embodiments if only one element is randomly marked with a certain type of marking, and two are necessary to prevent other elements from being modified, then other elements may be modified accordingly.

In various embodiments of the present disclosure, the gaming rules of the embodiments require that a winning combination of corresponding element must include a series of corresponding adjacent elements. In some embodiments of the present disclosure, series of corresponding adjacent elements can be dynamically identified. Dynamic identification includes locating element series or segments that can take any number of forms. As opposed to classic three reel strip slot matching, where a series of winning symbols could only be formed along one row, dynamic identification allows segments to be formed in many other ways, including series and segments that repeatedly change direction along their length.

Not all embodiments of the present disclosure require a series of corresponding adjacent elements. For example, payouts can be calculated according to scatter pay methods. A scatter pay method identifies a number of corresponding elements and issues a payout. In various embodiments of the present disclosure, the number of corresponding elements must meet a threshold in order to trigger a payout. In contrast to rules that require elements of winning series to be adjacent to one another, scatter pay methods allow elements to correspond to one another while not being adjacent and/or proximally located to one another.

Various embodiments of the present disclosure including marking elements such that the elements become null elements or otherwise presenting one or more null elements. In various embodiments of the disclosure, null elements contain symbols, or alternatively lack symbols, which prevent the elements from corresponding with other elements. For example, in some embodiments of the present disclosure, null elements may not be used to form combinations that trigger payouts. As one or ordinary skill in the art will understand upon reading this disclosure, the addition of null elements diminishes the chances of forming winning combinations. The use of null elements can be used to control the odds of a player winning and/or enhance the thrill of game play.

In some embodiments of the present disclosure, a null characteristic of an element may be the function that is replaced with a first function when it is determined that no other elements are associated with the first function. The replacement of null functions may be most anticipated and enjoyed by players, as null elements could otherwise represent the elements players least like to see introduced in a playing grid. In some embodiments, it is null element functionality that is added in a subsequent round of game play if it was not present in a previous round of game play.

Different than the replacement of null elements during the course of game play, some embodiments of the present disclosure replace the elements associated with the highest payouts. In such embodiments, game play transitions from a failed chance to trigger the highest possible win to a more likely win with a smaller payout. Such a feature will enhance player excitement, as when the high value symbols appear before a player, the enjoyment of seeing the high value symbols are two fold: the high value symbols could be associated with the biggest wins, and second, even if the big win does not materialize, these high value symbols may change function to enable other combinations to form or enhance other wins (e.g., multiplier).

Various embodiments of the present disclosure utilizing dynamic element function comprise marking elements of a play area and adding at least one function to all elements marked with a first type of marking if no elements of the play area are marked with a second type of marking, wherein the user is able to select the function added, the first type of marking, and/or the second type of marking. User selection of the function added allows a game player to select his or her own bonus and/or strategically think which type of replacement/addition will provide the greatest reward. User selection of the first type of marking allows a user to determine where the additional functionality will be implemented in the play area. Each of these selections can add elements of strategy into the game and/or provide the user with a greater sense of participation and control in the game outcome, each of which increases user enjoyment and the chances of a player playing longer. Such user selection aspects can be added to any embodiment referenced herein.

In various embodiments of present disclosure using dynamic element function, an added or replacement function, symbol, and/or characteristic is randomly selected from a plurality of different functions, symbols, and/or characteristics. In some embodiments, the plurality of different functions, symbols, and/or characteristics could be exhibited in the play area before the addition or replacement. However, in some other embodiments, some functions, symbols, and/or characteristics are reserved for addition or replacement and cannot be exhibited before the addition or replacement.

The devices and methods of the present disclosure can employ the use of a pay table. A pay table contains criteria for issuing payouts and information about the payouts. Different elements, markings, and combinations can be listed in a pay table, along with an associated payout amount. Pay tables can also include information and criteria for evaluating and applying bonuses, such as multipliers and additional plays.

The various embodiments illustrated herein (e.g., FIGS. 1A-3D) and/or described herein can correspond, or be modified to correspond, to any of the embodiments described herein (e.g., flow charts of FIGS. 4A-5). For example, the process of markings and/or changing element function in one embodiment can be performed in another embodiment. Moreover, the game play aspects are not limited in the gaming environments presented. For example, although a 2×5 grid 200 is illustrated in FIGS. 2A-B, any size grid, larger or smaller, could alternatively be used while utilizing the aspects of dynamic element function presented herein.

As is described more fully below, element function can include aggregate element function. Aggregate element function can add, delete, modify, or in some manner change functionality of one or more elements of a play area based on an aggregate of what is present in the play area. For example, aggregate element function can attribute a total value functionality to all elements of a play area that contributed to the calculation of the total value.

Figure 6A:
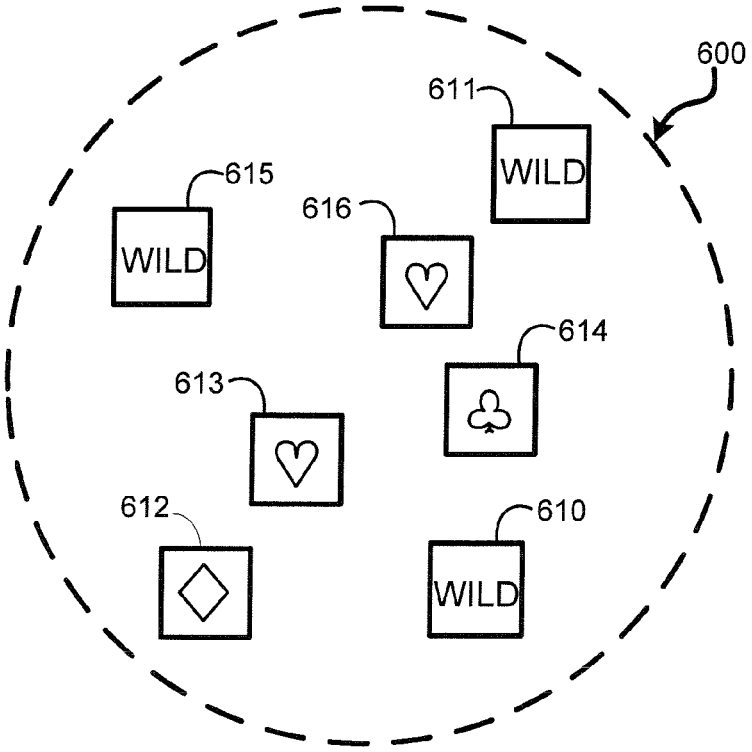
FIGS. 6A-B illustrate an embodiment of a gaming activity using aggregate element function.
Figure 6B:
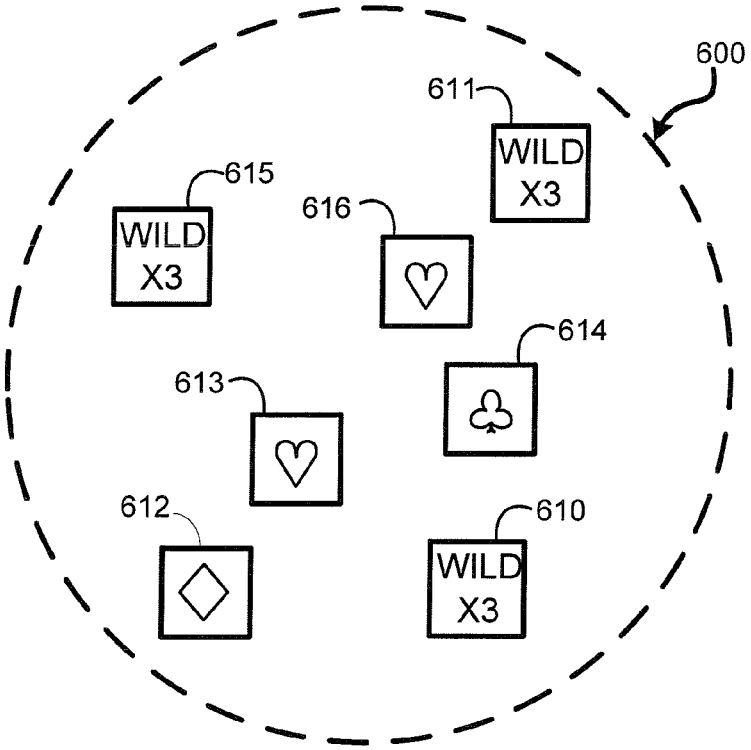

FIGS. 6A-B illustrate an embodiment having aggregate element function. In FIG. 6A, a play area 600 includes a plurality of elements 610-616. Elements 610-616 have each been marked in some manner. For example, elements 612-614 and 616 are marked with symbols.

Elements 610, 611, and 615 of the play area 600 are marked as wild, which invokes wild functionality for each of these elements. An element having wild functionality enables that element to function as though it was marked with any other type of marking to correspond to the other elements/markings to facilitate forming winning combinations of elements. For example, the rules of the embodiment of FIGS. 6A-B require a minimum number of commonly marked elements within the play area 600 to trigger a payout. The minimum number of corresponding elements could be five, for example. While there are not five commonly marked elements (e.g., five elements marked with diamonds or five elements marked with hearts) there are three elements 610, 611, and 615 marked as wild, and these elements exhibiting wild functionality can then correspond to other elements, such as elements 613 and 616 marked with heart symbols. A payout can be issued based on the result of FIG. 6A because wild elements 610, 611, and 615 function as though they were marked with heart the symbol and elements 613 and 616 are marked with the heart symbol, meeting the threshold five corresponding elements in the play area 600. A payout is triggered by the occurrence of five corresponding elements in the play area 600. The embodiment of FIGS. 6A-B uses aggregate functionality to apply an augmented multiplier bonus to this payout.

Aggregate function, as used herein, includes adding, substituting, discontinuing, or otherwise modifying one or more functions of a game element or marking to change the functionality of the game element or marking based on consideration of attributes of multiple game elements or markings. The game element and the multiple game elements may be commonly marked, which groups these elements together for consideration of their attributes. In some embodiments, such aggregate function includes adding or multiplying attribute values of a plurality of elements to determine a total value and then applying the total value to all elements of the plurality. The total value can then be used as a multiplier, for example.

In the embodiment of FIGS. 6A-B, aggregate functionality applies to all elements marked as wild (elements 610, 611, and 615). A total value of 3 is calculated based on there being three elements marked as wild, each wild element therefore contributing an attribute value of 1. The total value is then attributed to each of the wild elements 610, 611, and 615 as a multiplier value, as shown in FIG. 6B. Any payouts triggered based on the five corresponding elements 610, 611, 613, 615, and 616 will benefit from the multiplier. There are several options for how the three multipliers from elements 610, 611, and 615 can be applied. For example, the payout for five hearts could be multiplied by 3 if, according to the rules of this particular embodiment, the multiplier tops out at the highest multiplier value of an element used to form the combination triggering the payout (e.g., a single payout will only be augmented by one multiplier value from one of the elements). Alternatively, the three multiplier values of elements 610, 611, and 615 used in the payout triggering combination of hearts could be added to yield a multiplier value of 9 or multiplied to yield a value of 27, which can then be applied to the payout, among other calculation options.

FIGS. 7A-E illustrate an embodiment utilizing aggregate functionality. The embodiment of FIGS. 7A-E includes a play area 700 inside of which are a plurality of elements arranged in a grid, such as elements 701-705. Extra columns and rows are illustrated to show that practically any size grid is contemplated for the various embodiments referenced herein, including a greater number of rows, a lesser number of rows, a greater number of columns, and/or a lesser number of columns than that used if FIGS. 7A-E or other embodiments.

Figure 7A:
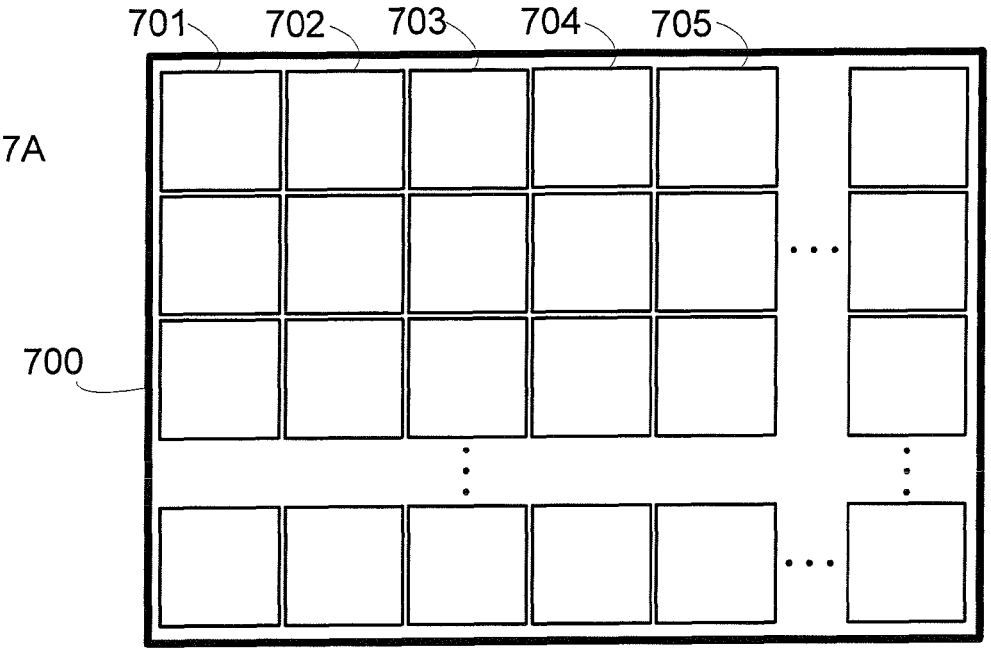
FIGS. 7A-E illustrate another embodiment of a gaming activity using aggregate element function.
Figure 7B:
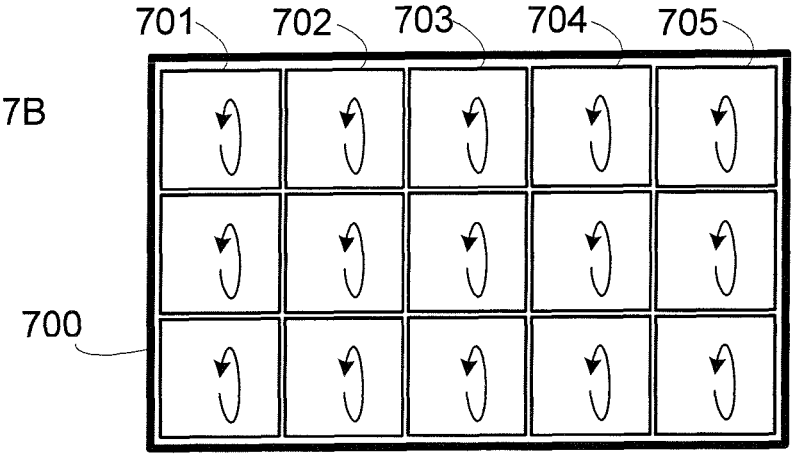

FIG. 7B shows a graphical representation of the process of marking the elements of the play area 700. Some embodiments might use physical spinning reels, graphically depicted spinning reels, or graphically depicted individual elements on which symbols can be represented. A circling arrow is used in each of the elements to represent the process by which symbols are respectively assigned to the elements of the play area 700.

Figure 7C:
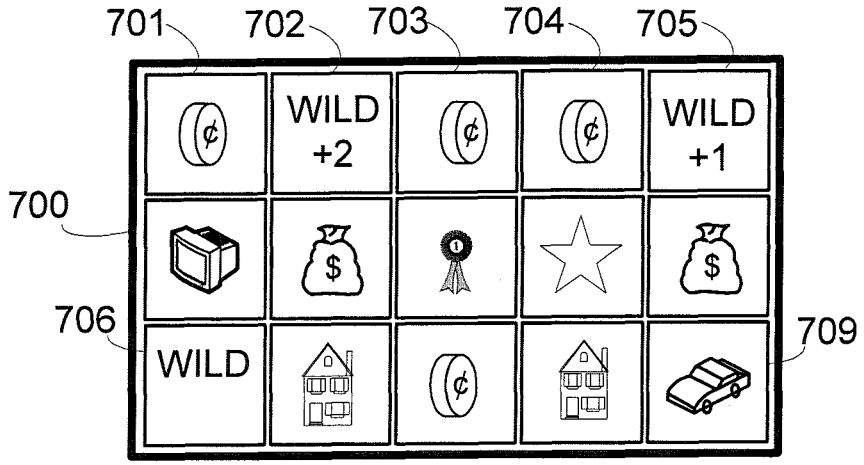

FIG. 7C shows that the elements of the play area 700 have been marked with various symbols. For example, elements 701, 703, and 704 are marked with coin symbols. Elements 702, 705, and 706 are marked as wild.

According to the particular embodiment of FIGS. 7A-E, each element marked as wild is also provided a chance to be marked with an attribute value. Accordingly, elements 702 and 705 are marked with +2 and +1 attributes respectively.

Element 706 is effectively marked with a +0 attribute. As discussed elsewhere herein, the attribute values can be aggregated in various ways to determine a total value, which is then applied to all elements of a certain type, such as wild elements for which an attribute value was assigned. The total value can be a multiplier value, which is the case in FIGS. 7A-E, although not all embodiments are limited in this way.

Figure 7D:
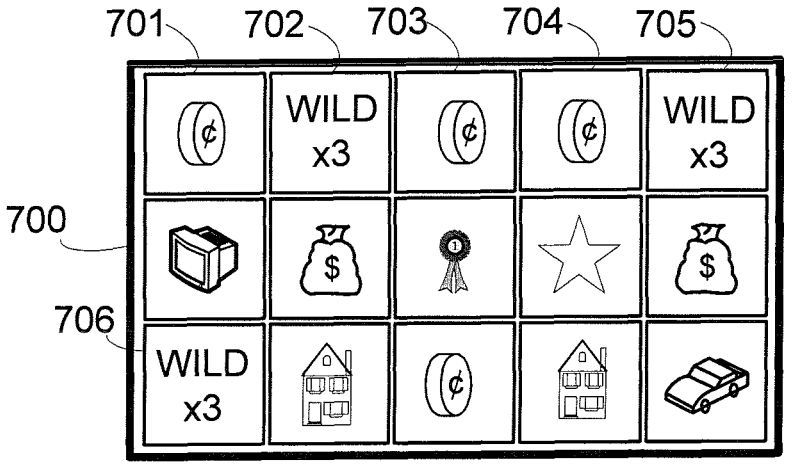

In the particular embodiment of FIGS. 7A-E, the attribute values are summed to calculate an aggregate multiplier value. The attribute calculation for wild elements 702, 705, and 706 is therefore 2+1+0=3. FIG. 7D shows that this aggregate multiplier value has been applied to each of the wild elements 702, 705, and 706. A multiplier in this and other embodiments works by increasing a payout associated with a winning combination that uses a multiplier element to form the winning combination, the payout being increased by multiplication with the multiplier value.

Figure 7E:
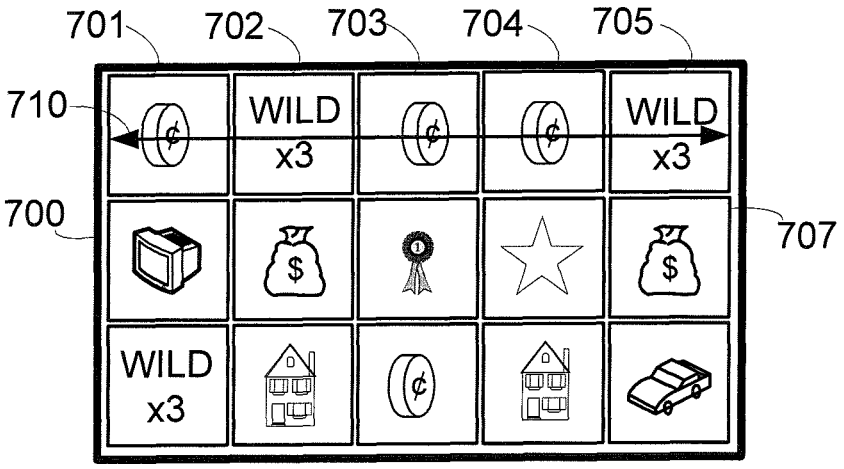

FIG. 7E shows identification of a winning combination of adjacent corresponding elements that benefit from aggregate multiplier functionality. Elements 701-705 form a winning combination of elements that triggers a payout because in the embodiment of FIGS. 7A-E a winning combination is formed by any series of five adjacent corresponding symbols along a payline. These elements correspond to one another because each is either marked with a common symbol (coin symbol) or is marked as wild which allows that element to function as though it were marked with the common symbol. A combination of five elements marked with any common symbol type (e.g., coin, house, etc) corresponds to a respective payout amount of a paytable, with a different payout amount for each combination of symbol-types.

It is further noted that each winning combination of the embodiment of FIGS. 7A-E must be formed by a series of adjacent elements along a payline, a rule which various other embodiments also abide. The paylines in FIGS. 7A-E run along any string of adjacent elements connecting the left most column of elements with the right most column of elements of the play area 700 between all combinations of elements of those columns. The top of the first row (elements 701-706) of the play area 700 is one such payline.

FIG. 7E shows line 710 tracing a winning series of corresponding adjacent elements that triggers a payout. The elements 701-706 correspond because each is enabled with coin functionality by way of being marked with a coin symbol or being marked as wild.

The elements 701-706 of the winning combination includes wild elements 702 and 706, which due to aggregate functionality are both enabled with ×3 multiplier functionality. Accordingly, the payout of the winning combination of elements 701-706 is increased by a multiplier value. The winning combination of elements 701-706 includes two multiplier elements. As discussed herein, the payout for the symbol combination (e.g., 5 coin symbols) could be multiplied by the aggregate multiplier value once (e.g., the payout for 5 coin symbols is multiplied by 3). However, in this and various other embodiments particular consideration is given to the fact that two multiplier elements make up the winning combination. Specifically, the multiplier values of each multiplier element used in a winning combination are summed to augment the payout associated with the winning combination. Therefore, the payout for 5 coin symbols (elements 701-706) is multiplied by 6 (3+3=6) based on the outcome shown in FIG. 7E. It is noted that other ways of considering multiple multipliers in a single winning combination of elements are contemplated (e.g., multiplying the multipliers, just using the highest multiplier, just using the lowest multiplier, determining an average of the multipliers, or performing some other mathematical calculation), which could be used to modify the embodiment of FIGS. 7A-E or any embodiment referenced herein.

Figure 8A:
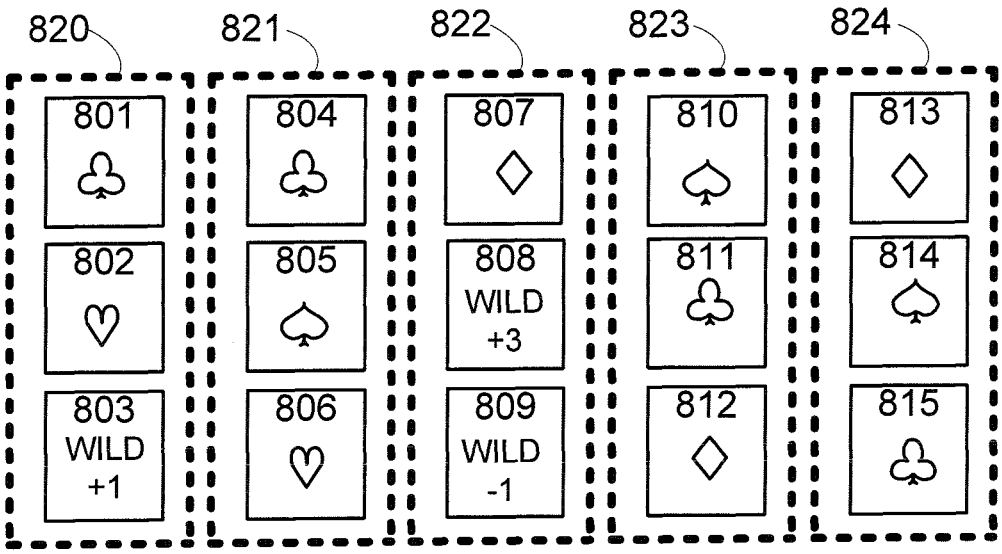
FIGS. 8A-B illustrate another embodiment of a gaming activity using aggregate element function.
Figure 8B:
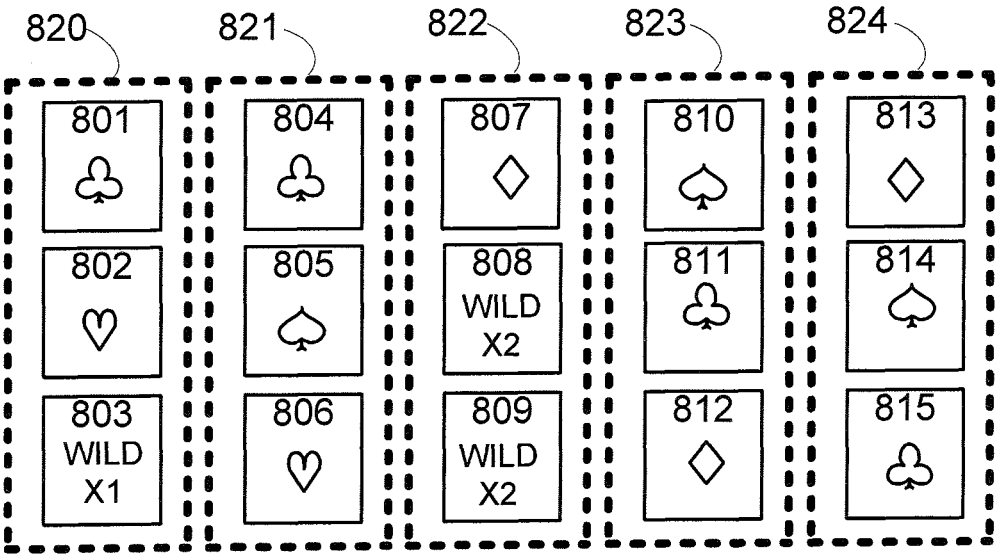

FIGS. 8A-C illustrates an embodiment of the present disclosure having aggregate functionality. A plurality of elements 801-815 have been populated with symbols. For example, element 802 was marked with a heart symbol. The marking of elements 801-815 can be done in any manner referenced herein.

The elements 801-815 are arranged in five columns 820-824. In the embodiment of FIGS. 8A-B, aggregate functionality applies separately for wilds in each column. For example, column 820 has only 1 wild element 803 with an attribute value of +1. Therefore, element 803 has a ×1 multiplier in FIG. 8B, which is effectively of no multiplier value. Wild element 803 derives no benefit from the attributes of wild elements 808 and 809, which are in a different column 822. Wild elements 808 and 809 are within the same column 822 and therefore associated attribute values (+3 and −1) can be considered with each other.

In the embodiment of FIGS. 8A-B, attribute values are summed, such that the total attribute value is ×2 (3−1=2). The ×2 total multiplier value is applied back to elements 808 and 809 as shown in FIG. 8B, but not to wild element 803 because this element is not in the same column as wild elements 808 and 809. Any winning combination of elements that uses either of elements 808 and 809 will be increased by multiplication of an associated payout by the ×2 multiplier value.

Although columns are used in the embodiment of FIGS. 8A-B to limit the areas used for aggregate functionality (i.e. aggregate of each column separately), other types of areas additionally or alternatively may be used, such as rows, regions, or other apportionment of a play area.

Figures 9, 10:
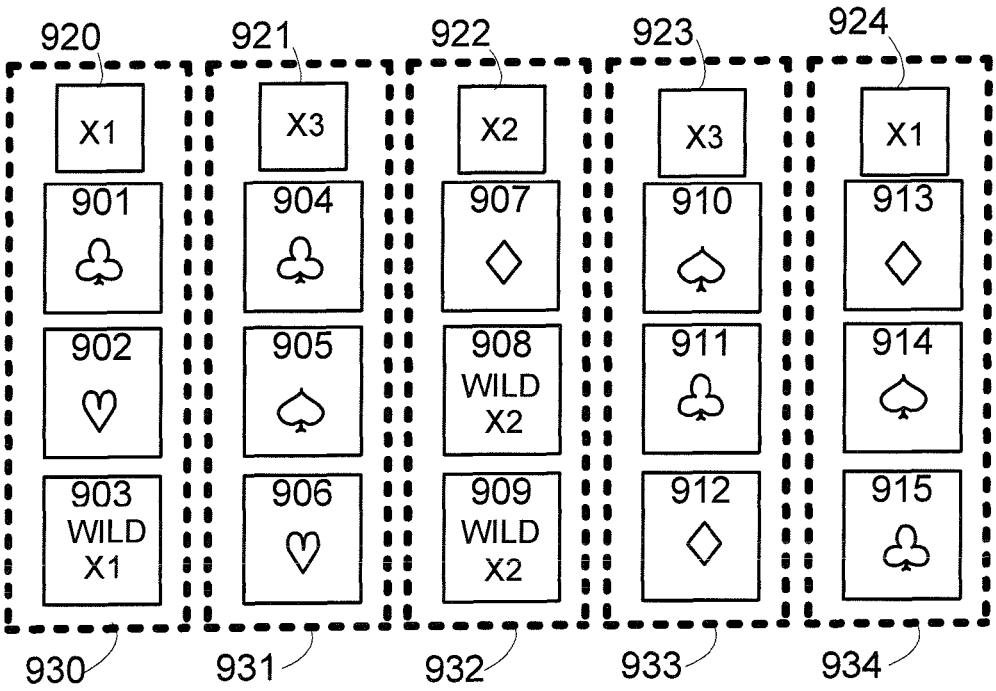
FIG. 9 illustrates another embodiment of a gaming activity using aggregate element function.
FIG. 10 illustrates a table of various options of aggregate element function.

FIG. 9 illustrates an embodiment having functionality in which all elements of a particular type of a particular region are enabled with aggregate multiplier functionality of a separate indicator associated with the region. FIG. 9 includes a plurality of elements 901-915 arranged into respective columns 930-934, each of the columns 930-934 associated with a respective indicator 920-924. The elements 901-915 are marked, some of which are marked as wild (elements 903, 908, and 909). A multiplier value is applied to each wild element, the multiplier value based on a value indicated by one of the indicators 920-924 that is associated with the column containing the wild element. For example, wild element 903 is in column 930, which is associated with indicator 930 displaying a multiplier value of ×1. Therefore, the ×1 multiplier value is attributed to element 903. Wild elements 908 and 909 are in column 932, which is associated with indicator 922 displaying a multiplier value of ×2. Therefore, the ×2 multiplier value is attributed to each of elements 908 and 909 as shown in FIG. 9.

As in various other embodiments referenced herein, winning combinations using any of the wild elements 903, 908, and 909 will be multiplied by the multiplier value. If two wild elements are used to form a winning combination, then the multiple multiplier values can be combined in any manner referenced herein.

As discussed previously, there are several ways in which the attributes of elements (e.g., wild elements) can be aggregated to yield a total value. For example, the attributes of elements could be multiplied instead of added. The table of FIG. 10 shows a variety of different ways that attributes of elements (e.g., wild elements) can be aggregated to yield a total multiplier value that is applied to all elements associated with the attributes (e.g., the wild elements). It is noted that other ways of aggregating attributed aspects of elements besides those listed in the table 1000 are contemplated.

Figure 11A:
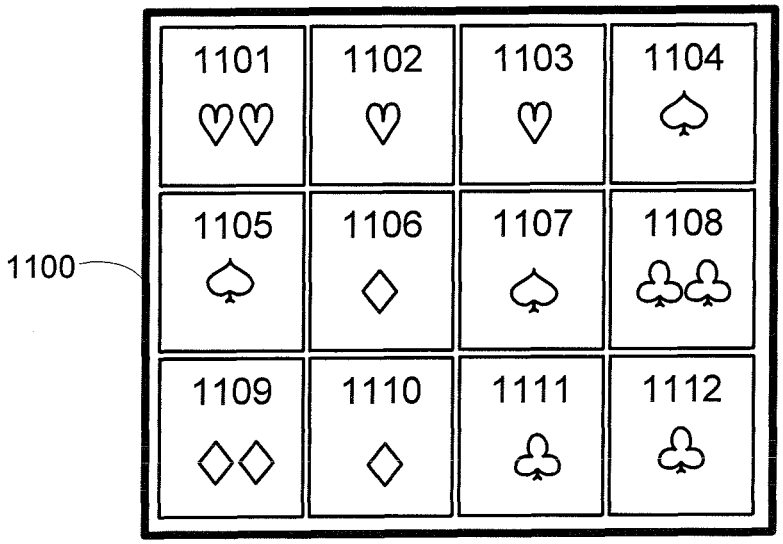
FIGS. 11A-B illustrate another embodiment of a gaming activity using aggregate element function.
Figure 11B:
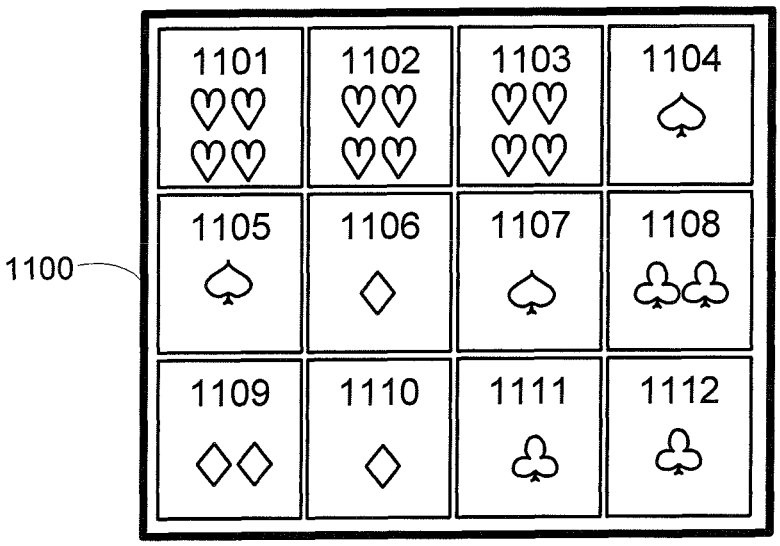

Although many embodiments discussed herein involve aggregating attribute values of wild elements to calculate a total multiplier value that is reapplied to each wild element, not all embodiments are so limited. For example, FIGS. 11A-B shows aggregate element function of a selected element type (not necessarily wild). In FIG. 11A, a play area 1100 includes a plurality of elements 1101-1112 arranged in a grid. Each of the elements 1101-1112 is marked with one or more symbols. For example, element 1101 is marked with two heart symbols and element 1109 is marked with two diamond symbols.

In the embodiment of FIGS. 11A-B, one of the symbol types (hearts, diamonds, clubs, spades) is selected, such as by random selection. The quantity of the symbols of the selected type are aggregated (e.g., summed, multiplied, highest number used) to yield a total amount and the total amount is attributed to all of the elements marked with at least one of the selected symbol types.

In the particular scenario of FIGS. 11A-B, the heart symbol type is selected. Therefore, the quantity of heart symbols from all elements marked with the heart symbol-type (elements 1101-1103) are aggregated to yield a total value. Although calculation of a total value can be done in any manner referenced herein, the particular embodiment of FIGS. 6A-B sums all of the symbols of the selected symbol-type and reattributes the summed number of symbols to each element marked with at least one of the selected symbols. In FIG. 11A, elements 1101-1103 have two, one, and one heart symbols, respectively, which sums to four. Accordingly, elements 1101-1103 are each marked with four heart symbols in FIG. 11B.

Various different rules can be used to calculate payouts in the embodiment of FIGS. 11A-B. For example, the symbols of each symbol-type may be respectively compared to a threshold, and a payout paid if the number of symbols of a type exceeds the threshold. For example, the total number of twelve heart symbols may exceed a threshold number of ten symbols, triggering a payout. A payout may be based on a series of corresponding adjacent elements, such as elements 1101-1103, if a series can be as short as three elements. The quantity of heart symbols can then be used to modify the payout or may be used to trigger a bonus game.

Figure 12:
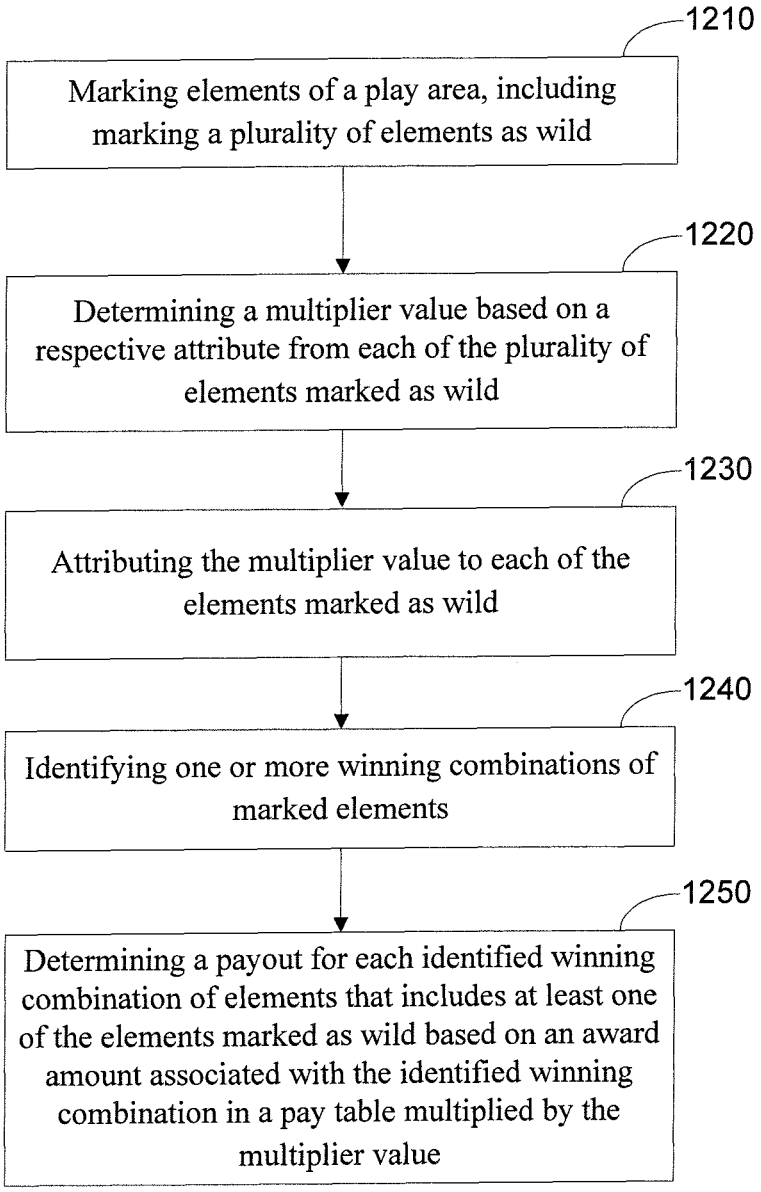
FIG. 12 is a flow diagram of an exemplary embodiment of a method for using aggregate element function.

FIG. 12 illustrates a method for carrying out various embodiments concerning aggregating element function. The method includes marking 1210 elements of a play area, including marking a plurality of elements as wild. The method of FIG. 12 can be practiced on embodiments that don't include a plurality of wild symbols for every round of game play, but this occurrence is specified in step 1210 because such are the conditions that trigger the attribute aggregating feature.

Marking 1210 can be done in any manner referenced herein, and can include attributing designator values to each of the wild elements. The possible attribute values can be limited, such as any one of −1, 0, 1, 2, or 3, for example, or unlimited. A multiplier value can then be determined 1220 based on the respective attributes of the plurality of elements marked as wild. As shown in the chart of FIG. 10, this can include but is not limited to adding, multiplying, or selecting between the various attribute values of the wild elements.

The determined 1220 multiplier value is attributed 1230 to each of the elements marked as wild. Attributing 1230 enables each of the wild elements with multiplier functionality, such that the multiplier bonus will be applied to an award if one of the wild elements is used in forming a winning combination. In some embodiments attributing 1230 includes marking or in some manner indicating the multiplier value on each of the wild elements, however various embodiments do not expressly indicate the multiplier value on each wild element.

Based on the markings 1210 of the elements, one or more winning combinations of the marked elements can be identified 1240. The formation and identification 1240 of winning combinations of elements can be done in any manner described herein, such as horizontal series of adjacent elements, dynamic identification, or scatter pay based series, but not all embodiments are limited in these manners.

A payout can then be determined 1250 for each identified 1240 winning combination of elements. An award prescribed by a paytable can be paid out for each combination. To the extent that one or more of the winning combinations includes a wild element, the award amount is multiplied by the multiplier value and then paid out. If multiple wild elements are used in a winning combination, then the multiplier values for each of the wild elements can be summed or multiplied. For example, if three wilds are used in a winning combination and the multiplier value is two, then an award according to a paytable could be multiplied by six (for multiplier value addition) or eight (for multiplier value multiplication) to determine 1250 the payout.

It is noted that the method outlined in FIG. 12 can correspond to the embodiment shown in FIGS. 6A-8B, however each of these embodiments is not necessarily limited to the limitations of the other. Moreover, while the embodiments of FIGS. 6A-8B and 12 use wild elements for attribute values that are used to determine an aggregate multiplier value which is then attributed to all of the wild elements, various other embodiments use a different type of element (i.e. not an element marked as wild) for these same functions. For example, all elements marked with a particular type of marking (e.g., star symbol), a randomly selected marking type, or randomly selected elements (regardless of how marked) can additionally or alternatively be associated with respective attributed values from which a multiplier value is determined and attributed to each of the elements associated with the attributed values.

Figure 13:
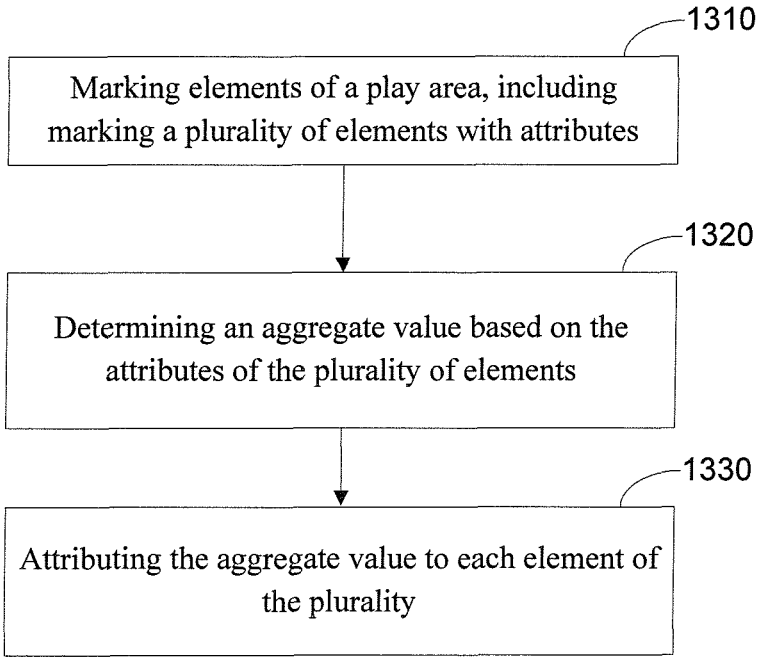
FIG. 13 is another flow diagram of an exemplary embodiment of a method for using aggregate element function.

In some embodiments, it is not a particular type of marking that is marked with an attribute value, but some elements are randomly selected to include respective attribute values and then are attributed with the multiplier value that is calculated based on an aggregate of attribute values. The elements with attribute values may not be commonly marked, and might have markings which do not allow them to correspond. If any of the randomly selected elements is used in a winning combination, a payout can be calculated by multiplying an award amount associated with the winning combination according to a paytable with the multiplier value. FIG. 13 demonstrates some of these options.

FIG. 13 illustrates a flowchart corresponding to a method concerning aggregate element function. The method of FIG. 13 includes marking 1810 elements of a play area, including marking a plurality of elements with attributes. The attributes can be numerical designators randomly selected for each element of the plurality, as discussed elsewhere herein. The attributes could also be a quantity of symbols, such as in FIGS. 11A-B. The plurality of elements can be randomly selected relative to all elements of the play area. The plurality of elements (i.e. those attributed) could be those marked in a particular way, such as the wild elements, elements marked with a particular symbol type, or elements randomly selected.

The method of FIG. 13 further includes determining 1320 an aggregate value based on the attributes of the plurality of elements. This can include summing all of the attributes, multiplying the attributes, or in some manner considering all of the attributes to yield a total value. Step 1320 could be performed in any manner of the table 1000 of FIG. 10, for example.

Once determined 1320, the aggregate value is attributed 1330 to each element of the plurality. Attributing 1330 includes associating the aggregate value functionality to each element of the plurality. FIG. 7D demonstrates attributing 1330 the aggregate value (×3 multiplier) to each element of the plurality (elements 702, 705, and 706) relative to FIG. 7C. FIGS. 6A-B, 8A-B also illustrate such attributing 1330 results.

In various embodiments, the attribute values are not necessarily attributed to one type of element, such as only elements marked wild or elements marked with a particular type of symbol. Rather, the elements attributed with an attribute value are randomly selected. For example, in FIG. 7C instead of all wild elements being given attribute values, elements 701 and 709, which have different symbols, could have been marked with +2 and +3 attribute values respectively. Then, if either of these elements was used in a winning combination, such as element 701, then a ×5 multiplier (2+3=5) could have been applied to the associated payout.

A payout associated with a winning combination of markings 1310 can be modified based on including one of the plurality of elements attributed with the aggregate value. The modification can include the payout being multiplied by the aggregate value. If multiple of the plurality of elements are used in a single winning combination, the aggregate values of these elements can be summed, multiplied, or in some manner combined in any manner referenced herein.

In some embodiments, a play area is marked and if at least a predetermined number of elements are marked with a common marking-type (e.g., star symbol) but these elements are not used in forming a winning combination of elements, then these symbols can be changed into wilds and the play area reevaluated to determine if this change created any new winning combinations. In such embodiments, functionality of some elements is changed based on what was not previously present in the play area.

In some embodiments, one or more elements will be made wild (or enabled with some other functionality) and then made to move about the play area while the elements and markings of the play area are reevaluated to see if the relocation of the one or more elements forms a new winning combination. This relocating can continue until one of the one or more moving elements reaches the perimeter of the play area, all of the one or more moving elements reaches the perimeter of the play area, the moving one or more elements have visited all play area locations and a reevaluation performed, the moving one or more elements have visited a predetermined number of locations and reevaluations performed for each location, the play area has been reevaluated while the moving one or more elements has been located in a space that does not form a winning combination, and/or the play area has been reevaluated while the moving one or more elements has been located in a space that does form a winning combination.

In some embodiments, attribute values are only assigned and/or revealed to a player if a triggering event occurs, such as the appearance of a bonus symbol. In such embodiments, the aggregate functionality is only in play if the triggering event occurs.

In various embodiments, a game utilizing aggregate functionality is played by marking elements of a play area, changing a function of the elements that are marked with a particular type of marking, the change in function dependent upon all of the elements marked with the particular type of marking, and identifying winning combinations of marked elements that trigger a payout, wherein the function of the elements that are marked with the particular type of marking are used to enhance the payout. The particular type of marking can be, for example, a marking signifying wild functionality, or a random selected marking type. Changing the function can include, for example, adding, increasing, or changing a multiplier value.

Not all embodiments of the present disclosure require a series of corresponding adjacent elements. For example, payouts can be calculated according to scatter pay methods, as in FIGS. 1A-B and 6A-B. Scatter pay methods identify a number of corresponding elements and issue a payout. In various embodiments of the present disclosure, the number of corresponding elements must meet a threshold in order to trigger a payout. In contrast to rules that require elements of winning series to be adjacent to one another, scatter pay methods allow elements to correspond to one another while not being adjacent and/or proximally located to one another.

In various embodiments discussed herein, an aggregate value can serve as a multiplier value to increase a payout. These embodiments could be modified such that the aggregate value instead augments a player's wager. Typically, a higher payout is paid for a higher wager. Therefore, multiplying a player's wager by the aggregate value attributed to an element used in a winning combination will cause the payout to increase without the payout directly being multiplied by the aggregate total.

The devices and methods of the present disclosure can employ the use of a pay table. A pay table contains criteria for issuing payouts and information about the payouts. For example, a pay table can associate different award amounts for various different combinations of symbols, the award amounts generally correlated with the probability of occurrence of the various symbol combinations. Different elements, markings, and combinations can be listed in a pay table, along with an associated payout amount. Pay tables can also include information and criteria for evaluating and applying bonuses, such as multipliers and additional plays.

Various embodiments using aggregate functionality comprise attributing a mathematical value to one or more special symbols; presenting a plurality of symbols in a game play area including one or more paylines; determining a mathematical result using the mathematical values of the one or more special symbols that were presented in the game play area; analyzing each of the paylines for winning payout results; and applying the mathematical result to the winning payout results to provide a total payout result.

In some of these embodiments, attributing a mathematical value to one or more special symbols comprises associating a numeric value to at least one of the one or more special symbols; determining a mathematical result using the mathematical values comprises calculating a sum, product, highest numeric, or lowest numeric, of the numeric values of the at least one of the one or more special symbols; and applying the mathematical result to the winning payout results comprises multiplying the calculated sum/product/highest numeric/lowest numeric to the winning payout results to provide the total payout result.

In some of the above embodiments, the mathematical value is displayed together with (e.g., within) the special symbol. In some embodiments, the mathematical value is displayed together with the special symbol only if a triggering event occurs, such as a plurality of the special symbols being presented in the game play area.

In some of the above embodiments, the special symbols are wild symbols. In some of the above embodiments, the special symbols are decided in advance, while in some others the special symbols are randomly selected during game play.

In some of the above embodiments, different mathematical values are attributed to a plurality of the special symbols. In some of these embodiments, attributing different mathematical values to the plurality of the special symbols comprises attributing sequentially increasing mathematical values to each of the plurality of special symbols presented during multiple rounds of game play.

Aggregate and dynamic functionality as described herein can be used together to function in the same embodiment. For example, symbols missing from a first round or marking can be added to a play area in a second round to those elements with attributes, these attributes themselves being aggregated and the aggregate result being applied to the elements originally marked with attributes.

Figure 14:
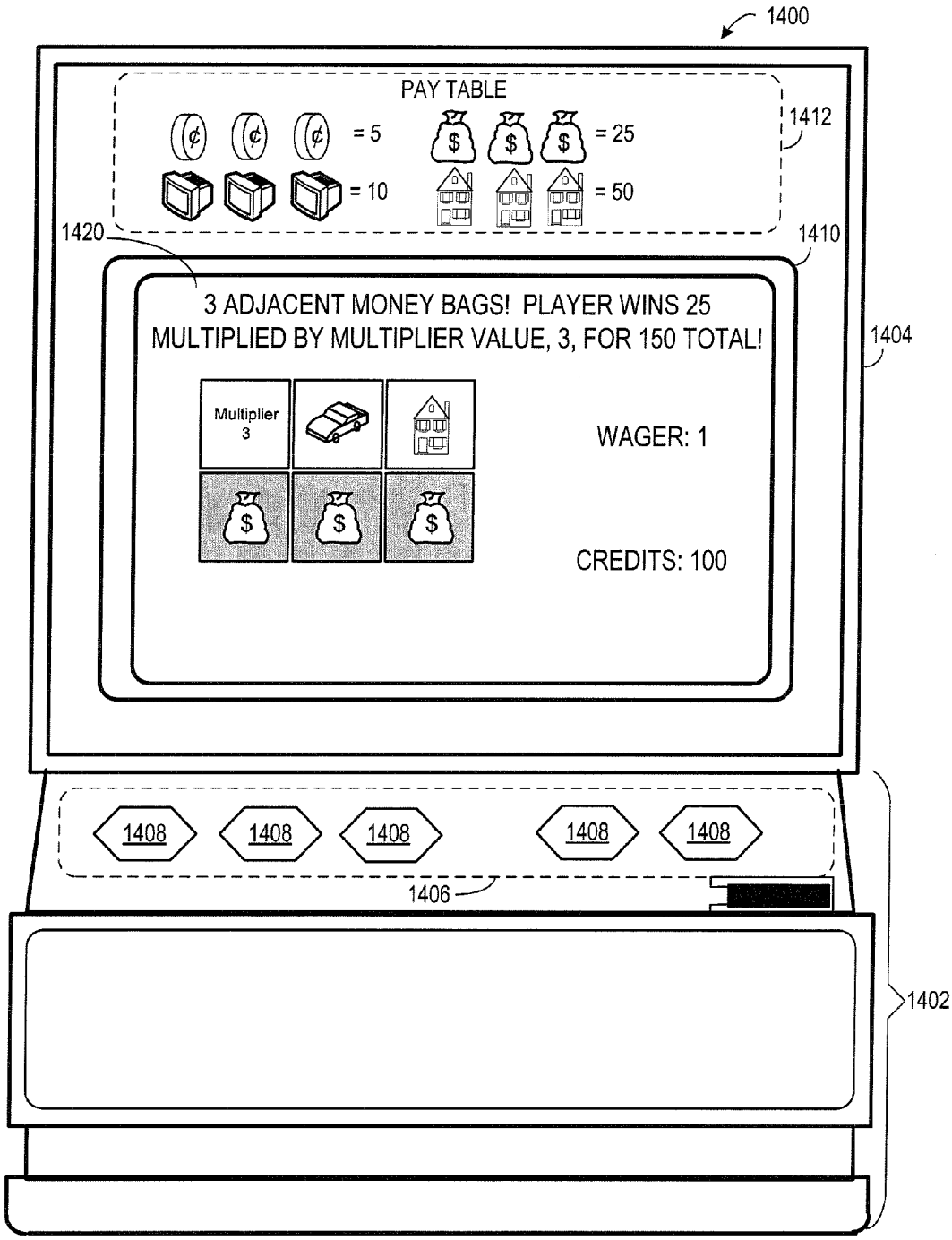
FIG. 14 is an embodiment of a casino-style gaming device in which the principles of the present invention may be applied.

FIG. 14 is an embodiment of a casino-style gaming device in which the principles of the present disclosure may be applied. The slot machine 1400 is a structure including at least a computing system, a housing, and a display. The housing includes a base 1402 and a display device 1404 to allow the slot machine 1400 to be a self-supported, independent structure. The base 1402 includes structure supporting the slot machine 1400, and also includes a user interface 1406 to allow the user to control and engage in play of the slot machine 1400. The particular user interface mechanisms associated with user interface 1406 is dependent on the type of gaming machine. For example, the user interface 1406 may include one or more buttons, switches, joysticks, levers, pull-down handles, trackballs, voice-activated input, or any other user input system or mechanism that allows the user to participate in the particular gaming activity. The user interface 1406 allows the user to enter coins or otherwise obtain credits through vouchers, tokens, credit cards, etc. Various mechanisms for entering such vouchers, tokens, credit cards, coins, point tickets, etc. are known in the art. For example, coin/token input mechanisms, card readers, credit card readers, smart card readers, punch card readers, and other mechanisms may be used to enter wagers. The user input may include a plurality of buttons 1408, which allow the user to initiate the game play in accordance with the present disclosure, enter a number of credits to play, select options, cash out, automatically bet the maximum amount, etc. It should be recognized that a wide variety of other user interface options are available for use in connection with the present disclosure, including pressing a button on a gaming machine, touching a segment of a touch-screen, entering text, entering voice commands, or other known user entry methodology.

Returning now to FIG. 14, the display device 1404 includes a display screen 1410. The display device may take on a variety of forms depending on what type of presentation is to be provided. For example, a play area 1420 is provided. The video display screen may be implemented in a variety of manners, including electronically represented with outputs shown on conventional electronic displays, such as a liquid crystal displays (LCD), dot matrix, plasma, CRT, LED, electro-luminescent display, or generally any type of video display known in the art.

The play areas of the present disclosure can be presented in various ways. For example, a play area can comprise a display grid. Various types of display grids are contemplated in the scope of the present disclosure, including vertical and horizontal lines creating spaces of rectangles and/or squares. A display grid could also be comprised of triangles, hexagons, ovals, circles and other shapes.

A display grid could be comprised of several reel strips with various markings on the periphery of the reel strips. Several reel strips with a common axis placed together can form a grid, with each reel strip representing a vertical column and adjacent markings on the aligned reels representing a horizontal row. A display grid could also be printed on a surface, such as a piece of paper or board. A grid could also be represented by projected light.

A display grid can also be presented by use of video means, such as with a video slot machine. In a video slot machine, the reel strips are not represented by physical material, but rather include electronically stored symbol patterns, i.e., a virtual reel strip. By using virtual reel strips for each of the rows or columns of a play area, there is no physical correlation between display rows or columns as there are with mechanical reel strips. For example, in the context of mechanical reel strips, three symbols presented in a column across three paylines are physically restricted to that particular order, since the reel strip is presented across three rows. In an exemplary embodiment of the present disclosure, there is no such relationship and each subpart of the grid can display a marking independent of any other subpart. Furthermore, there are other advantages by using video representation, including faster game play, greater flexibility in game types and variations, and representation of things that would otherwise be physically complicated or impossible.

Also associated with the display device 1404 is an optional winning guide area 1412, where information associated with the potential winning combinations may be presented (e.g., information corresponding to that of a pay table). This area may also provide an indication of the requisite symbols, scatter pays, symbol lengths, symbol combinations, symbol locations, etc. that result in payouts to the participant. This information may be part of the display screen 1410, or alternatively may be separate from the display screen 1410 and provided directly on a portion of the display device 1404 structure itself. For example, a backlit colored panel may be used as the winning guide area 1412. Further, this information may be provided on an entirely separate display screen (not shown).

Figure 15:
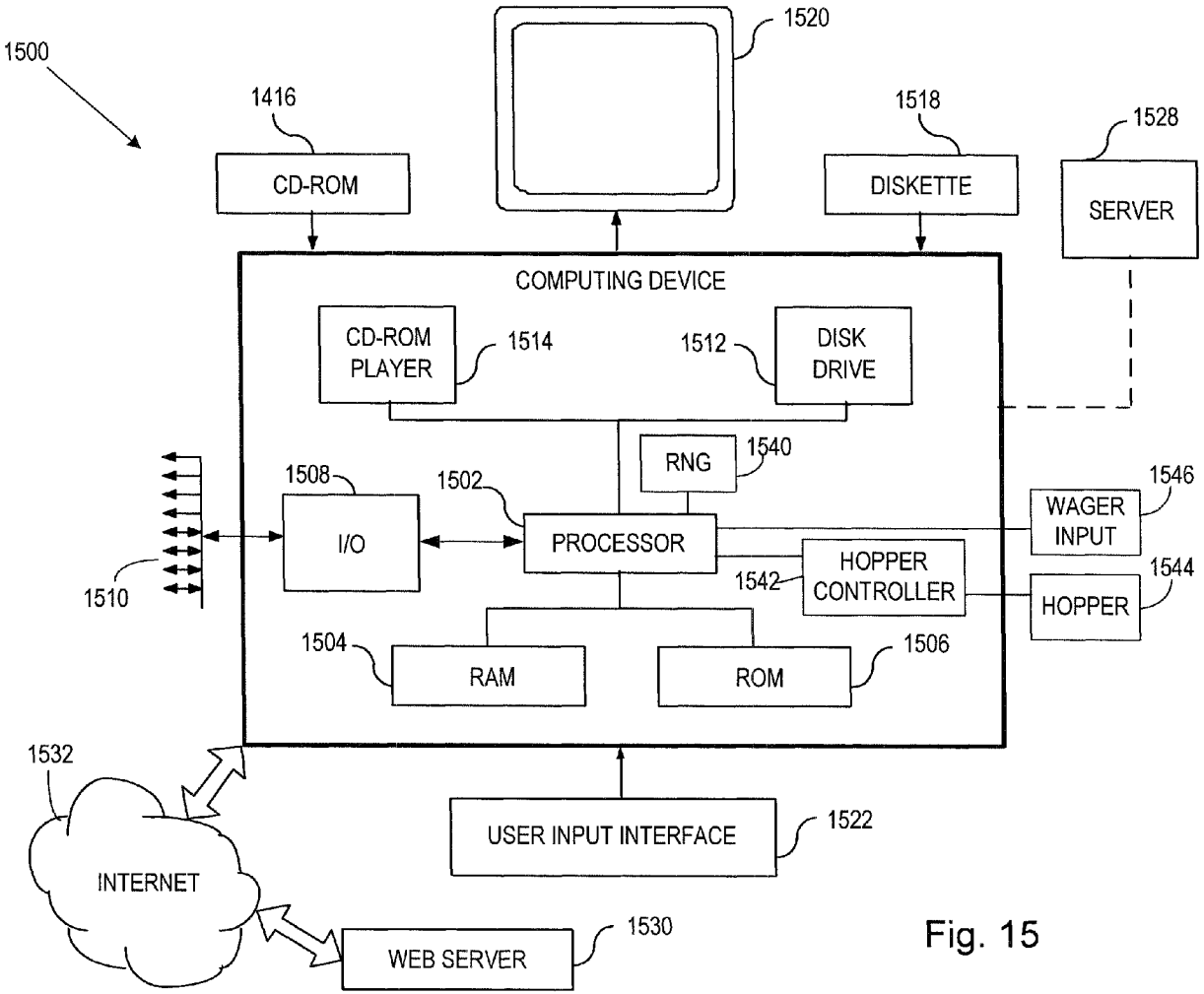
FIG. 15 illustrates a representative computing system capable of carrying out operations in accordance with the invention.

The gaming machines described in connection with the present disclosure may be independent casino gaming machines, such as slot machines or other special purpose gaming kiosks, video games, or may be computing systems operating under the direction of local gaming software and/or remotely-provided software such as provided by an application service provider (ASP). The casino gaming machines utilize computing systems to control and manage the gaming activity. An example of a representative computing system capable of carrying out operations in accordance with the present disclosure is illustrated in FIG. 15.

Hardware, firmware, software or a combination thereof may be used to perform the various gaming functions, display presentations and operations described herein. The functional modules used in connection with the present disclosure may reside in a gaming machine as described, or may alternatively reside on a stand-alone or networked computer. The computing structure 1500 of FIG. 15 is an example computing structure that can be used in connection with such electronic gaming machines, computers, or other computer-implemented devices to carry out operations of the present disclosure.

The example computing arrangement 1500 suitable for performing dynamic element function gaming activities in accordance with the present disclosure typically includes a central processor (CPU) 1502 coupled to random access memory (RAM) 1504 and some variation of read-only memory (ROM) 1506. The ROM 1506 may also be other types of storage media to store programs, such as programmable ROM (PROM), erasable PROM (EPROM), etc. The processor 1502 may communicate with other internal and external components through input/output (I/O) circuitry 1508 and bussing 1510, to provide control signals, communication signals, and the like.

Chance-based gaming systems such as slot machines, in which the present disclosure is applicable, are governed by random numbers and processors. Electronic reels can be used to display the result of the digital reels which are actually stored in computer memory and "spun" by a random number generator (RNG). RNGs are well-known in the art, and may be implemented using hardware, software operable in connection with the processor 1502, or some combination of hardware and software. In accordance with generally known technology in the field of slot machines, the processor 1502 associated with the slot machine, under appropriate program instruction, can simulate the vertical rotation of multiple reels. Generally, the RNG continuously cycles through numbers, even when the machine is not being played. The slot machine selects, for example, three random numbers. The numbers chosen at the moment the play is initiated are typically the numbers used to determine the final outcome, i.e., the outcome is settled the moment the reels are spun. The resulting random numbers are generally divided by a fixed number. This fixed number is often thirty-two, but for slot machines with large progressive jackpots it may be even greater. After dividing, the remainders will be retained. For example, if the divisor was one-hundred twenty-eight, the machine would have three remainders ranging from zero to one-hundred twenty-seven. The remainders may be considered as stops on virtual reels. If the divisor was one-hundred twenty-eight, then the virtual reels would each have one-hundred twenty-eight stops with each stop being equally likely. Each stop on the virtual reel may be mapped to a stop on an actual reel or displayed reel image. These reel images may then be displayed on the display 1520. The present disclosure is operable using any known RNG, and may be integrally programmed as part of the processor 1502 operation, or alternatively may be a separate RNG controller 940. RNGs are well known in the art, and any type of RNG may be implemented for the standard mode of play and/or the bonus mode of play in accordance with the present disclosure.

The computing arrangement 1500 may also include one or more data storage devices, including hard and floppy disk drives 1512, CD-ROM drives 1514, and other hardware capable of reading and/or storing information such as DVD, etc. In one embodiment, software for carrying out the gaming operations in accordance with the present disclosure may be stored and distributed on a CD-ROM 1516, diskette 1518 or other form of media capable of portably storing information. These storage media may be inserted into, and read by, devices such as the CD-ROM drive 1514, the disk drive 1512, etc. The software may also be transmitted to the computing arrangement 1500 via data signals, such as being downloaded electronically via a network, such as the Internet. Further, as previously described, the software for carrying out the functions associated with the present disclosure may alternatively be stored in internal memory/storage of the computing device 1500, such as in the ROM 1506. The computing arrangement 1500 is coupled to the display 1520, which represents a display on which the gaming activities in accordance with the present disclosure are presented. The display 1520 merely represents the "presentation" of the video information in accordance with the present disclosure, and may be any type of known display or presentation screen, such as LCD displays, plasma display, cathode ray tubes (CRT), etc. Where the computing device 1500 represents a stand-alone or networked computer, the display 1520 may represent a standard computer terminal or display capable of displaying multiple windows, frames, etc. Where the computing device is embedded within an electronic gaming machine, such as slot machine 1400 of FIG. 6, the display 1520 corresponds to the display screen 1410 of FIG. 14. A user input interface 1522 such as a mouse or keyboard may be provided where the computing device 1500 is associated with a standard computer. An embodiment of a user input interface 1522 is illustrated in connection with an electronic gaming machine 1400 of FIG. 14 as the various "buttons" 1408. Other user input interface devices include a keyboard, a mouse, a microphone, a touch pad, a touch screen, voice-recognition system, etc.

In various embodiments of the present disclosure, various aspects of the game, as described herein, may be player controlled. For example, a player may place bets, select game types, select play area types, select display grid types, select themes, select symbols, select functions, select symbol-function associations, select colors, and/or select other options disclosed herein or known in the art.

The computing arrangement 1500 may be connected to other computing devices or gaming machines, such as via a network. The computing arrangement 1500 may be connected to a network server 1528 in an intranet or local network configuration. The computer may further be part of a larger network configuration as in a global area network (GAN) such as the Internet. In such a case, the computer accesses one or more web servers 1530 via the Internet 1532.

Other components directed to slot machine implementations include manners of gaming participant payment, and gaming machine payout. For example, a slot machine including the computing arrangement 1500 may also include a hopper controller 1542 to determine the amount of payout to be provided to the participant. The hopper controller may be integrally implemented with the processor 1502, or alternatively as a separate hopper controller 1542. A hopper 1544 may also be provided in slot machine embodiments, where the hopper serves as the mechanism holding the coins/tokens of the machine. The wager input module 1546 represents any mechanism for accepting coins, tokens, coupons, bills, credit cards, smart cards, membership cards, etc. for which a participant inputs a wager amount.

Using the foregoing specification, the present disclosure may be implemented as a machine, process, or article of manufacture by using standard programming and/or engineering techniques to produce programming software, firmware, hardware or any combination thereof.

Any resulting program(s), having computer-readable program code, may be embodied within one or more computer-usable media such as memory devices or transmitting devices, thereby making a computer program product or article of manufacture according to the present disclosure.

As such, the terms "article of manufacture" and "computer program product" as used herein are intended to encompass a computer program existent (permanently, temporarily, or transitorily) on any computer-usable medium such as on any memory device or in any transmitting device.

One skilled in the art of computer science from the description provided herein will be able to combine the software created as described with appropriate general purpose or special purpose computer hardware to create a computer system and/or computer subcomponents embodying the present disclosure, and to create a computer system and/or computer subcomponents for carrying out methods of the present disclosure.

The foregoing description of the exemplary embodiment of the present disclosure has been presented for the purposes of illustration and description. It is not intended to be exhaustive or to limit the present disclosure to the precise form disclosed. Many modifications and variations are possible in light of the above teaching. For example, the present disclosure is not limited to what is traditionally known as "slot machines." Also, while the illustrated embodiments have been described in large part in connection with a "slot machine," other gaming systems and concepts are also within the scope of the invention, such as video poker games, card games, lotteries, and other casino events implementing a video screen. For example, a video poker game may utilize the present invention to provide multiple cards at each standard card display segment. It is thus intended that the scope of the invention be limited not with this detailed description, but rather by the claims appended hereto.

What is claimed is:

1. A method of facilitating a game on a gaming device having a display, a player input, a memory, a wager input device structured to accept currency, and a processor, wherein the memory stores a credit amount and a plurality of marking types including a first marking type having a dynamic functionality and a second marking type, the method comprising:

receiving a signal from the wager input device indicating acceptance of currency;

increasing the credit amount in memory based upon the received signal from the wager input device;

receiving a signal on the gaming device to initiate a game, the signal indicating a wager amount, where the credit amount is reduced by the wager amount;

randomly marking elements of a play area of the display with a plurality of markings in response to the game being initiated;

evaluating the plurality of markings to determine if any of the elements in the play area are marked with the second marking type;

changing markings on the elements marked with the first marking type in the play area to have the second marking type when no elements in the play area are marked with the second marking type based on the evaluation; and identifying one or more combinations of marked elements after the markings on the elements with the first marking type have been changed.

2. The method of claim 1, wherein the first marking type to be changed to the second marking type is randomly selected from the plurality of markings prior to evaluating the plurality of markings.

3. The method of claim 1, further comprising identifying corresponding combinations of the elements based on their respective markings both prior to and after changing the markings on the elements with the first marking type to the second marking type.

4. The method of claim 1, wherein changing markings on the elements marked with the first marking type in the play area to have the second marking type comprises replacing the at least one function of the elements marked with the first marking type with a second function associated with the second marking type.

5. The method of claim 4, wherein the second function is a wild function and the second marking type indicates that each element marked with the second marking type can function as wild.

6. The method of claim 4, wherein the second function is a multiplier function and the second marking type indicates that each element marked with the second marking type can function as a multiplier to increase a payout.

7. The method of claim 1, wherein changing markings on the elements marked with the first marking type in the play area to have the second marking type further comprises marking all elements marked with the first marking type with the second marking type so that each of the elements marked with the first marking type exhibit the first marking type and the second marking type.

8. The method of claim 1, wherein changing markings on the elements marked with the first marking type in the play area to have the second marking type further comprises replacing a previous function of the elements marked with the first marking type with a new type of function associated with the second marking type.

9. The method of claim 1, wherein the second marking type is a wild symbol marking type.

10. The method of claim 1, wherein the second marking type is a bonus symbol marking type.

11. A gaming apparatus for facilitating a game comprising:

a display device;

a wager input device structured to accept currency;

a memory to store a credit amount and a plurality of marking types including a first marking type having a dynamic functionality and a second marking type; and circuitry configured to:

receive a signal from the wager input device indicating acceptance of currency;

increase the credit amount in memory based upon the received signal from the wager input device;

receive a signal on the gaming device to initiate a game, the signal indicating a wager amount, where the credit amount is reduced by the wager amount;

facilitate presentation of a plurality of elements forming a grid on the display device in response to the game being initiated;

control marking the plurality of elements;

evaluate the plurality of markings on the display to determine if any of the elements in the play area are marked with the second marking type;

change markings on the elements marked with the first marking type in the play area to have the second marking type when no elements in the play area are marked with the second marking type based on the evaluation; and identify one or more combinations of marked elements after markings on the elements with the first marking type have been changed.

12. The gaming apparatus of claim 11, wherein the circuitry is configured such that the first marking type to be changed to the second marking type is randomly selected from the plurality of markings prior to evaluating the plurality of markings.

13. The gaming apparatus of claim 11, wherein the circuitry is further configured to identify corresponding combinations of the elements based on their respective markings both prior to and after changing the markings on the elements with the first marking type to the second marking type.

14. The gaming apparatus of claim 11, wherein the circuitry is configured such that the changing of the markings on the elements marked with the first marking type in the play area to have the second marking type comprises replacing the at least one function of the elements marked with the first marking type with a second function associated with the second marking type.

15. The gaming apparatus of claim 14, wherein the circuitry is configured such that the second function is a wild function and the second marking type indicates that each element marked with the second marking type can function as wild.

16. The gaming apparatus of claim 14, wherein the circuitry is configured such that the second function is a multiplier function and the second marking type indicates that each element marked with the second marking type can function as a multiplier to increase a payout.

17. The gaming apparatus of claim 11, wherein the circuitry is configured such that the changing of the markings on the elements marked with the first marking type in the play area to have the second marking type further comprises marking all elements marked with the first marking type with the second marking type so that each of the elements marked with the first marking type exhibit the first marking type and the second marking type.

18. The gaming apparatus of claim 11, wherein the circuitry is configured such that the changing of the markings on the elements marked with the first marking type in the play area to have the second marking type further comprises replacing a previous function of the elements marked with the first marking type with a new type of function associated with the second marking type.

19. The gaming apparatus of claim 11, wherein the second marking type is a wild symbol marking type.

20. The gaming apparatus of claim 11, wherein the second marking type is a bonus symbol marking type.

* * * * *